US011152168B1

(12) United States Patent
Wu et al.

(10) Patent No.: US 11,152,168 B1
(45) Date of Patent: Oct. 19, 2021

(54) KEYBOARD DEVICE

(71) Applicant: Primax Electronics Ltd., Taipei (TW)

(72) Inventors: Ming-Han Wu, Taipei (TW); Che-Wei Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/136,418

(22) Filed: Dec. 29, 2020

(30) Foreign Application Priority Data

Nov. 6, 2020 (TW) ..... 109138903

(51) Int. Cl.
*H01H 3/12* (2006.01)
*H01H 13/7065* (2006.01)

(52) U.S. Cl.
CPC ..... *H01H 13/7065* (2013.01); *H01H 3/125* (2013.01); *H01H 2221/058* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 10,607,793 B1 * 3/2020 Liu ..... G06F 3/0202
2014/0216905 A1 * 8/2014 Ma ..... H01H 3/122 200/344
2018/0025859 A1 * 1/2018 Chen ..... H01H 13/7065 200/5 A
2019/0227639 A1 * 7/2019 Chen ..... G06F 3/021
2019/0378666 A1 * 12/2019 Wang ..... H01H 13/14

* cited by examiner

*Primary Examiner* — Ahmed M Saeed
(74) *Attorney, Agent, or Firm* — Kirton McConkie; Evan R. Witt

(57) ABSTRACT

A keyboard device includes a membrane circuit board, a base plate and a key structure. The key structure a keycap, a first connecting element, a second connecting element, a stabilizer bar and an auxiliary bar. The first connecting element and the second connecting element are connected between the keycap and the base plate. The first connecting element has a first lateral side and a second lateral side. The second connecting element has a third lateral side and a fourth lateral side. The third lateral side faces the second lateral side. The stabilizer bar is pivotally coupled to the keycap, the first lateral side of the first connecting element and the fourth lateral side of the second connecting element. The auxiliary bar is pivotally coupled to the keycap, the second lateral side of the first connecting element and the third lateral side of the second connecting element.

9 Claims, 23 Drawing Sheets

KEYBOARD DEVICE

FIELD OF THE INVENTION

The present invention relates to an input device, and more particularly to a keyboard device.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. The membrane circuit board 12 comprises plural membrane switches 121 corresponding to the plural keys 10 and 10'. Each of the plural keys 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the membrane circuit board 12. Moreover, the elastic element 103 comprises a contacting part 1031.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L1 of the key 10' is much larger than the width W1 of the key 10'. The key 10' further comprises two stabilizer bars 104. Each stabilizer bar 104 comprises a transverse bar part 1041 and two hook parts 1042. The two hook parts 1042 are located at two ends of the transverse bar part 1041, respectively.

The base plate 11 comprises a first connecting structure 111 and a second connecting structure 112. The first connecting structure 111 and the second connecting structure 112 are protruded upwardly and penetrated through the membrane circuit board 12. The first connecting structure 111 comprises two first locking holes 1111. The second connecting structure 112 comprises two second locking holes 1121 corresponding to the two first locking holes 1111.

The transverse bar part 1041 of the stabilizer bar 104 is pivotally coupled to the keycap 101 of the key 10'. The two hook parts 1042 of the stabilizer bar 104 are penetrated through the corresponding first locking hole 1111 of the first connecting structure 111 and the corresponding second locking hole 1121 of the second connecting structure 112, respectively.

FIG. 4 schematically illustrates the actions of the stabilizer bar of the keyboard device as shown in FIG. 1. While the keycap 101 of the key 10' is moved upwardly or downwardly relative to the base plate 11, the stabilizer bar 104 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. While the keycap 101 of the key 10' is depressed and moved downwardly relative to the base plate 11, the two first hook parts 1042 of the stabilizer bar 104 readily collide with or knock on the base plate 11, the first connecting structure 111 and the second connecting structure 112. Since all of the stabilizer bar 104, the base plate 11, the first connecting structure 111 and the second connecting structure 112 are made of metallic material, the above actions between the metallic components result in the collision sound or the click sound. The collision sound or the click is unpleasant noise to the user.

In other words, the conventional keyboard device needs to be further improved.

SUMMARY OF THE INVENTION

An object of the present invention provides a keyboard device. The key structure of the keyboard device includes a keycap, a first connecting element, a second connecting element, at least one stabilizer bar and at least one auxiliary bar. The stabilizer bar and the auxiliary bar are connected between the keycap and the connecting element. Consequently, the stabilizer bar and the auxiliary bar will not readily collide with or knock on a base plate. During the operation, the generated noise is reduced. Consequently, the operating comfort of the user to use the keyboard device is enhanced.

The other objects and advantages of the present invention will be understood from the disclosed technical features.

In accordance with an aspect of the present invention, a keyboard device. The keyboard device includes a membrane circuit board, a base plate and a key structure. The base plate is located under the membrane circuit board. The key structure a keycap, a first connecting element, a second connecting element, at least one stabilizer bar and at least one auxiliary bar. The keycap is located over the membrane circuit board. The keycap is movable upwardly or downwardly relative to the membrane circuit board. The first connecting element is connected between the keycap and the base plate. The first connecting element has a first lateral side and a second lateral side, which are opposed to each other. The second connecting element is connected between the keycap and the base plate. The second connecting element has a third lateral side and a fourth lateral side, which are opposed to each other. The third lateral side faces the second lateral side. The at least one stabilizer bar is pivotally coupled to the keycap, the first lateral side of the first connecting element and the fourth lateral side of the second connecting element. The at least one auxiliary bar is pivotally coupled to the keycap, the second lateral side of the first connecting element and the third lateral side of the second connecting element. While the keycap is moved upwardly or downwardly relative to the membrane circuit board, the at least one stabilizer bar and the at least one auxiliary bar are correspondingly swung.

In an embodiment, the first connecting element includes a first frame, a second frame and a first pedestal, and the second connecting element includes a third frame, a fourth frame and a second pedestal. The first frame and the second frame are connected between the keycap and the first pedestal. The first pedestal is connected with the base plate. The first frame and the second frame are pivotally coupled to a first pivotal region. The third frame and the fourth frame are connected between the keycap and the second pedestal. The second pedestal is connected with the base plate. The third frame and the fourth frame are pivotally coupled to a second pivotal region. While the keycap is moved upwardly or downwardly relative to the membrane circuit board, the first frame and the second frame are correspondingly swung relative to the first pivotal region as a fulcrum and the third frame and the fourth frame are correspondingly swung relative to the second pivotal region as a fulcrum.

In an embodiment, the first frame includes a first sliding groove and a second sliding groove, which are opposed to each other. The second frame includes a third sliding groove and a fourth sliding groove, which are opposed to each other. The third frame includes a fifth sliding groove and a sixth sliding groove, which are opposed to each other. The fourth frame includes a seventh sliding groove and an eighth sliding groove, which are opposed to each other. The first sliding groove and the third sliding groove are located at the first lateral side of the first connecting element. The second sliding groove and the fourth sliding groove are located at the second lateral side of the first connecting element. The fifth sliding groove and the seventh sliding groove are located at the third lateral side of the second connecting element. The sixth sliding groove and the eighth sliding groove are located at the fourth lateral side of the second connecting element. The at least one stabilizer bar is pivotally coupled to the first sliding groove and the sixth sliding groove or pivotally coupled to the third sliding groove and the eighth sliding groove. The at least one auxiliary bar is pivotally coupled to the second sliding groove and the fifth sliding groove or pivotally coupled to the fourth sliding groove and the seventh sliding groove.

In an embodiment, the at least stabilizer bar includes plural stabilizer bars including a first stabilizer bar and a second stabilizer bar, and the at least one auxiliary bar includes plural auxiliary bars including a first auxiliary bar and a second auxiliary bar. The first stabilizer bar is pivotally coupled to the first sliding groove and the sixth sliding groove. The second stabilizer bar is pivotally coupled to the third sliding groove and the eighth sliding groove. The first auxiliary bar is pivotally coupled to the second sliding groove and the fifth sliding groove. The second auxiliary bar is pivotally coupled to the fourth sliding groove and the seventh sliding groove.

In an embodiment, the first stabilizer bar includes a first transverse bar part and two first hook parts, the second stabilizer bar includes a second transverse bar part and two second hook parts, the first auxiliary bar includes a third transverse bar part and two third hook parts, and the second auxiliary bar includes a fourth transverse bar part and two fourth hook parts. The two first hook parts are respectively located at two ends of the first transverse bar part. The two second hook parts are respectively located at two ends of the second transverse bar part. The two third hook parts are respectively located at two ends of the third transverse bar part. The two fourth hook parts are respectively located at two ends of the fourth transverse bar part. The two first hook parts of the first stabilizer bar are pivotally coupled to the first sliding groove and the sixth sliding groove. The two second hook parts of the second stabilizer bar are pivotally coupled to the third sliding groove and the eighth sliding groove. The two third hook parts of the first auxiliary bar are pivotally coupled to the second sliding groove and the fifth sliding groove. The two fourth hook parts of the second auxiliary bar are pivotally coupled to the fourth sliding groove and the seventh sliding groove.

In an embodiment, while the keycap is moved upwardly relative to the membrane circuit board, the first stabilizer bar, the second stabilizer bar, the first auxiliary bar and the second auxiliary bar are correspondingly swung. As the keycap is moved upwardly, the two first hook parts are moved within the first sliding groove and the sixth sliding groove along directions away from the first pivotal region and the second pivotal region, the two second hook parts are moved within the third sliding groove and the eighth sliding groove along the directions toward the first pivotal region and the second pivotal region, the two third hook parts are moved within the second sliding groove and the fifth sliding groove along the directions away from the first pivotal region and the second pivotal region, and the two fourth hook parts are moved within the fourth sliding groove and the seventh sliding groove along the directions away from the first pivotal region and the second pivotal region.

In an embodiment, while the keycap is moved downwardly relative to the membrane circuit board, the first stabilizer bar, the second stabilizer bar, the first auxiliary bar and the second auxiliary bar are correspondingly swung. As the keycap is moved downwardly, the two first hook parts are moved within the first sliding groove and the sixth sliding groove along directions toward the first pivotal region and the second pivotal region, the two second hook parts are moved within the third sliding groove and the eighth sliding groove along the directions toward the first pivotal region and the second pivotal region, the two third hook parts are moved within the second sliding groove and the fifth sliding groove along the directions toward the first pivotal region and the second pivotal region, and the two fourth hook parts are moved within the fourth sliding groove and the seventh sliding groove along the directions toward the first pivotal region and the second pivotal region.

In an embodiment, the first pedestal includes a first sliding groove, a second sliding groove, a third sliding groove and a fourth sliding groove, and the second pedestal includes a fifth sliding groove, a sixth sliding groove, a seventh sliding groove and an eighth sliding groove. The first sliding groove and the third sliding groove are located at the first lateral side of the first connecting element. The second sliding groove and the fourth sliding groove are located at the second lateral side of the first connecting element. The fifth sliding groove and the seventh sliding groove are located at the third lateral side of the second connecting element. The sixth sliding groove and the eighth sliding groove are located at the fourth lateral side of the second connecting element. The at least one stabilizer bar is pivotally coupled to the first sliding groove and the sixth sliding groove or pivotally coupled to the third sliding groove and the eighth sliding groove. The at least one auxiliary bar is pivotally coupled to the second sliding groove and the fifth sliding groove or pivotally coupled to the fourth sliding groove and the seventh sliding groove.

In an embodiment, the at least stabilizer bar includes plural stabilizer bars including a first stabilizer bar and a second stabilizer bar, and the at least one auxiliary bar includes plural auxiliary bars including a first auxiliary bar and a second auxiliary bar. The first stabilizer bar is pivotally coupled to the first sliding groove and the sixth sliding groove. The second stabilizer bar is pivotally coupled to the third sliding groove and the eighth sliding groove. The first auxiliary bar is pivotally coupled to the second sliding groove and the fifth sliding groove. The second auxiliary bar is pivotally coupled to the fourth sliding groove and the seventh sliding groove.

In an embodiment, the first connecting element and the second connecting element are butterfly-type connecting elements or scissors-type connecting elements.

From the above descriptions, the stabilizer bar and the auxiliary bar are connected between the keycap and the connecting element. Consequently, the stabilizer bar and the auxiliary bar will not readily collide with or knock on a base plate. During the operation, the generated noise is reduced. Consequently, the operating comfort of the user to use the keyboard device is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
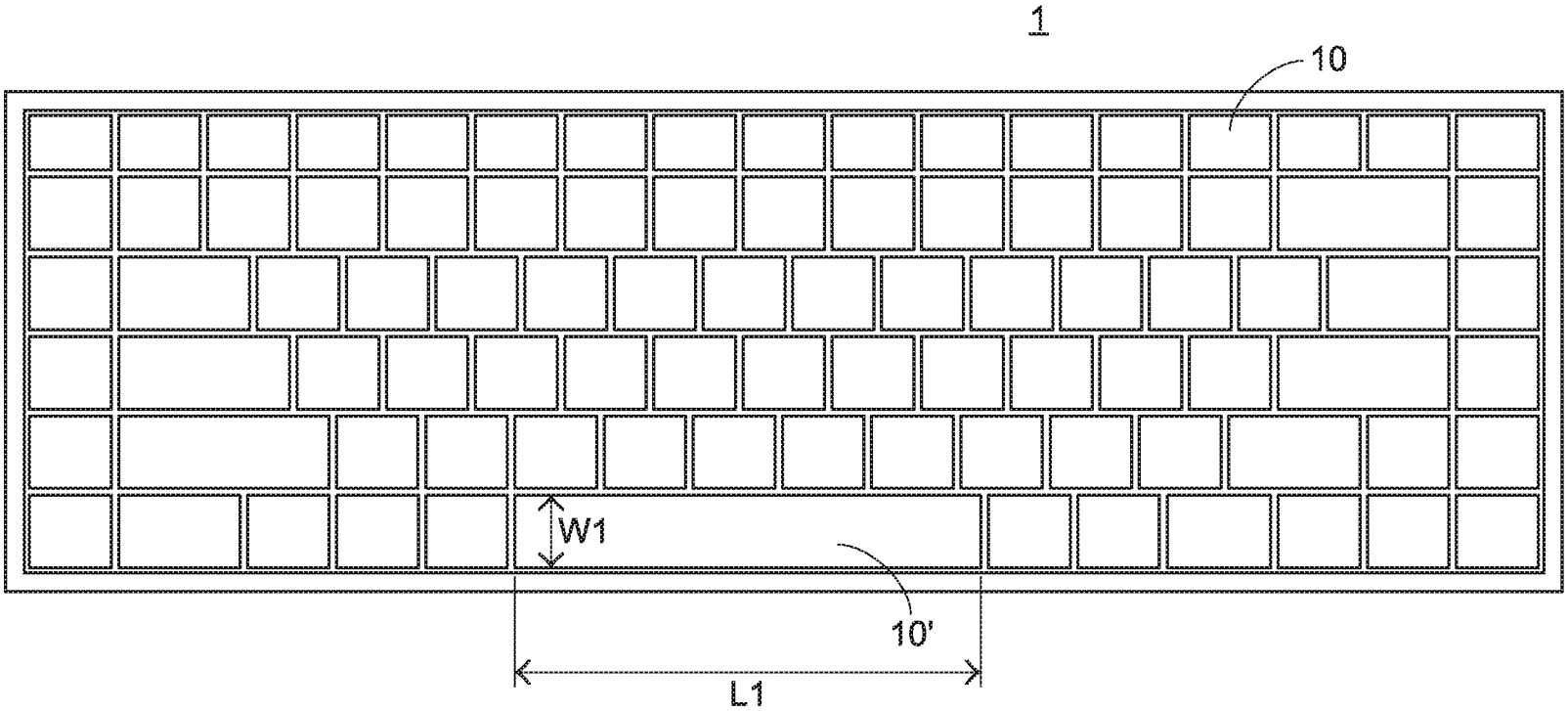
FIG.1 PRIOR ART
FIG. 1 is a schematic top view illustrating the outer appearance of a conventional keyboard device.
Figure 2:
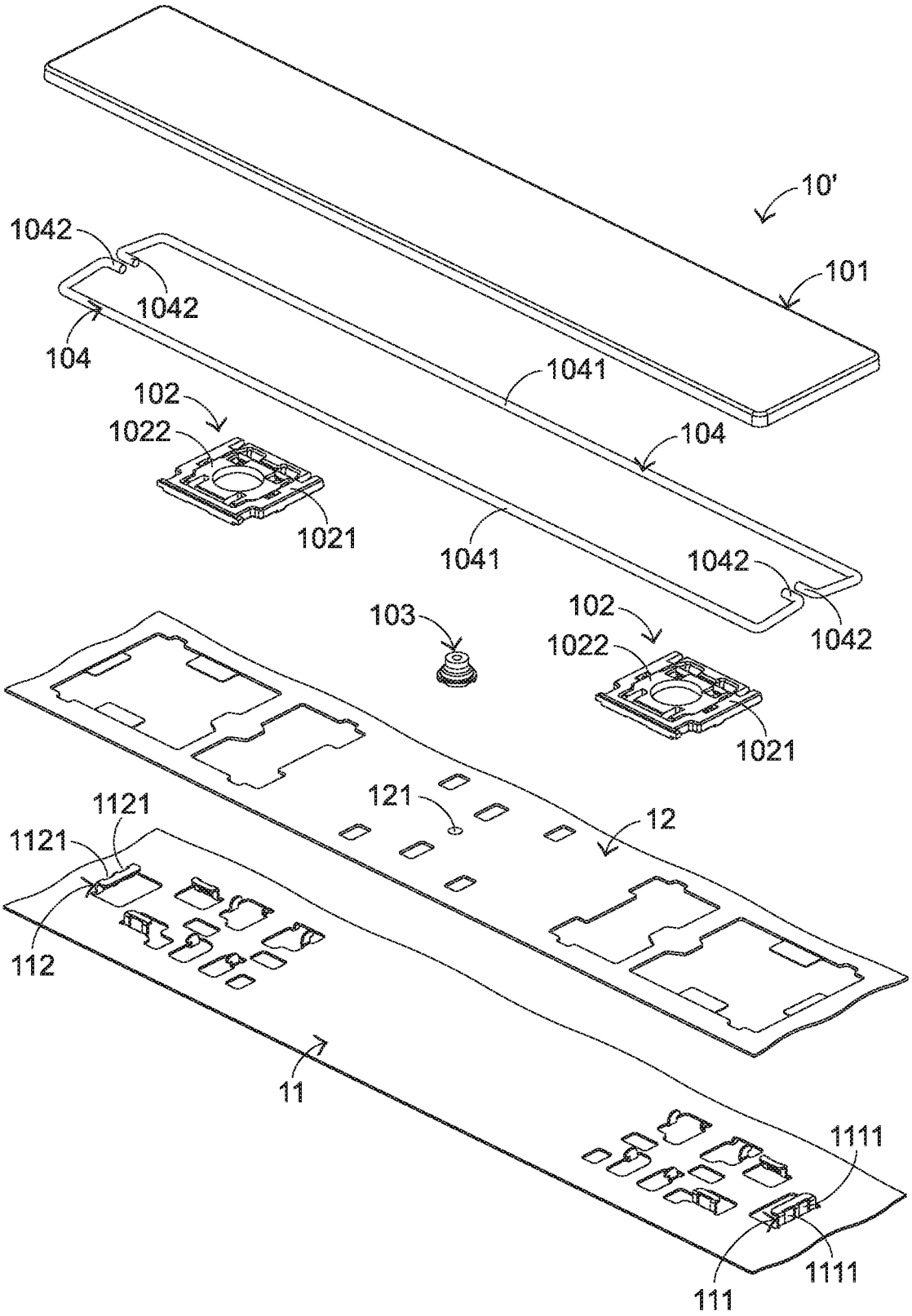
FIG.2 PRIOR ART
FIG. 2 is a schematic exploded view illustrating a portion of the keyboard device of FIG. 1 and taken along a viewpoint.
Figure 3:
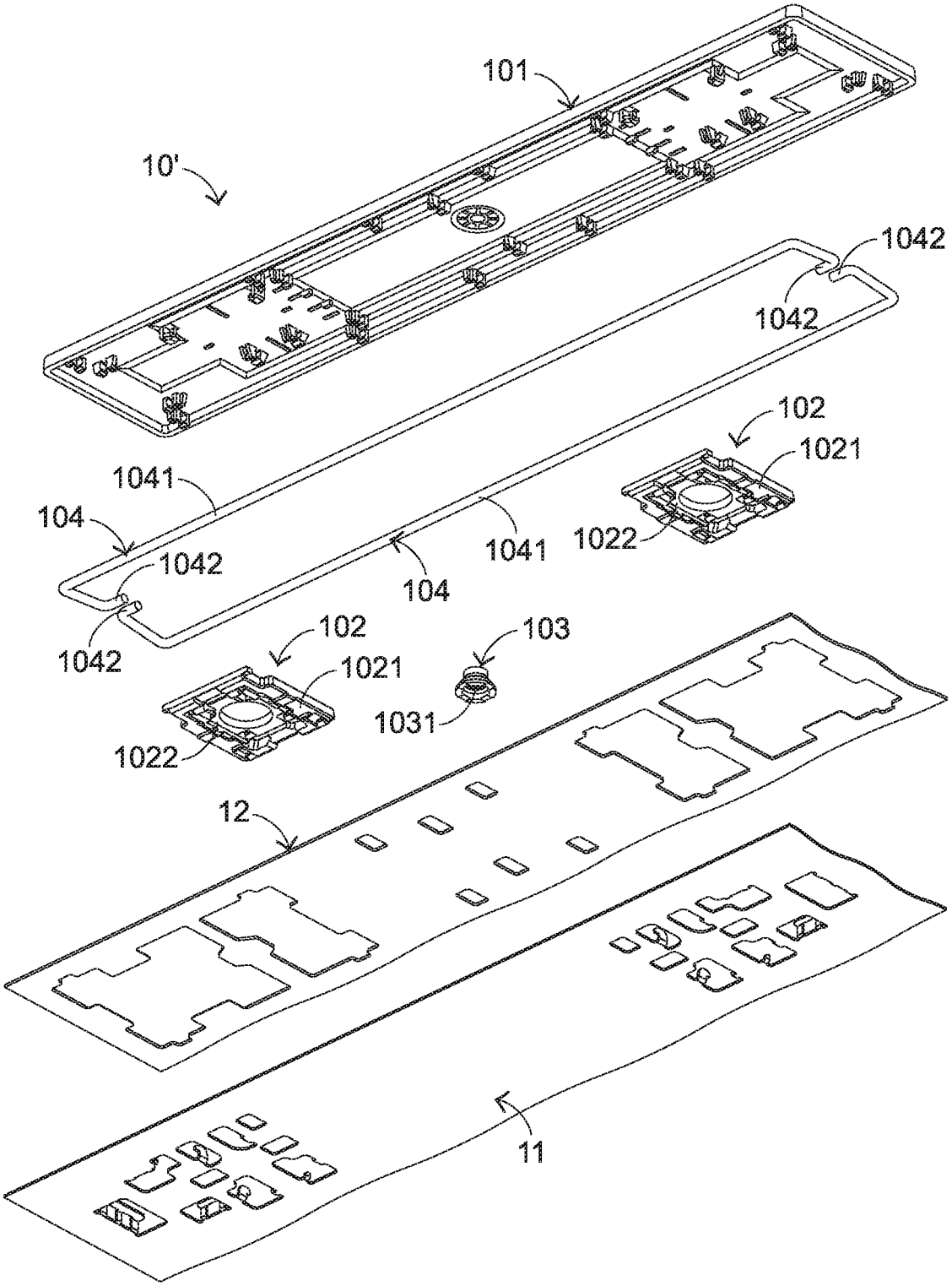
FIG.3 PRIOR ART
FIG. 3 is a schematic exploded view illustrating a portion of the keyboard device of FIG. 1 and taken along another viewpoint.
Figure 4:
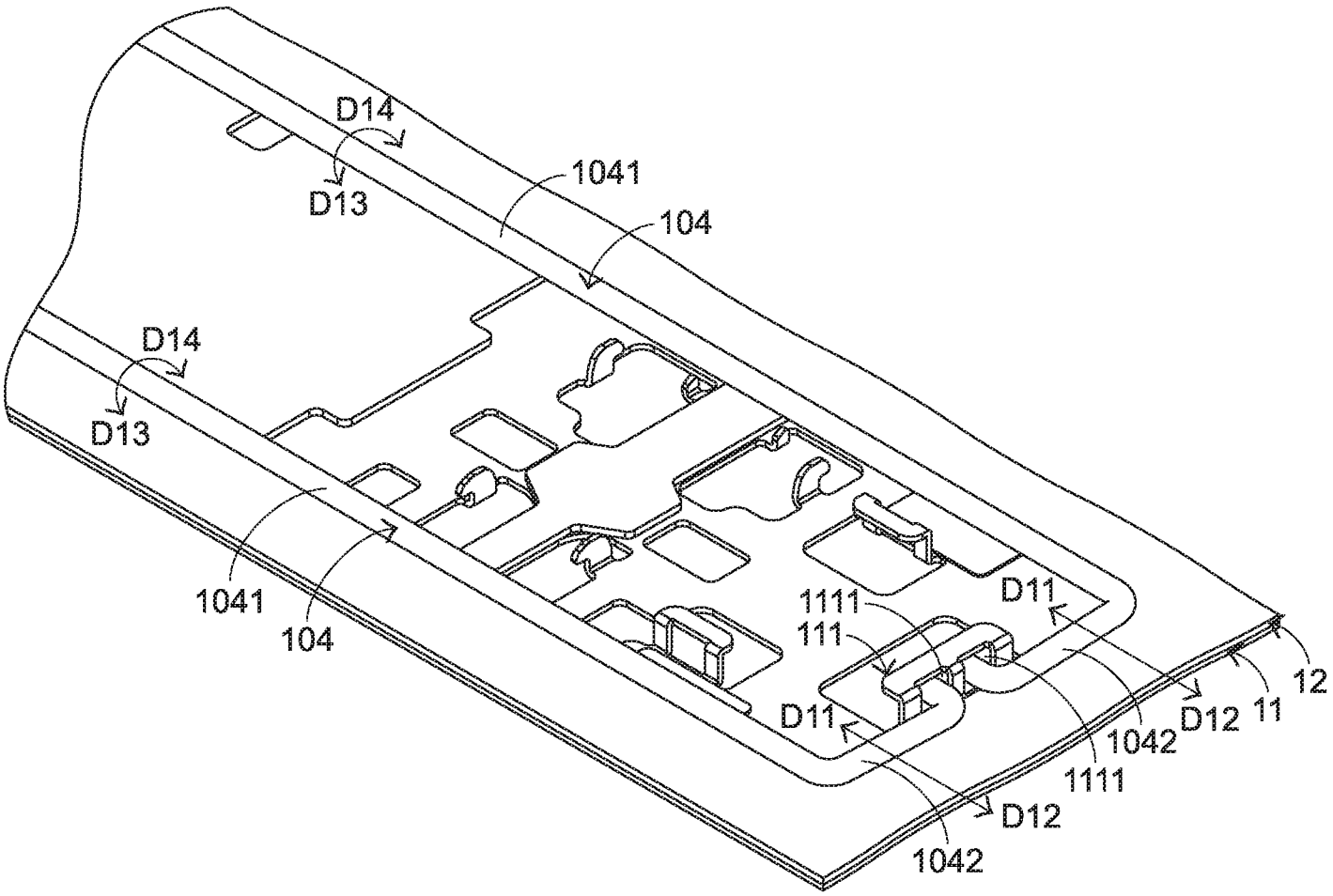
FIG.4 PRIOR ART
FIG. 4 schematically illustrates the actions of the stabilizer bar of the keyboard device as shown in FIG. 1.
Figure 5:
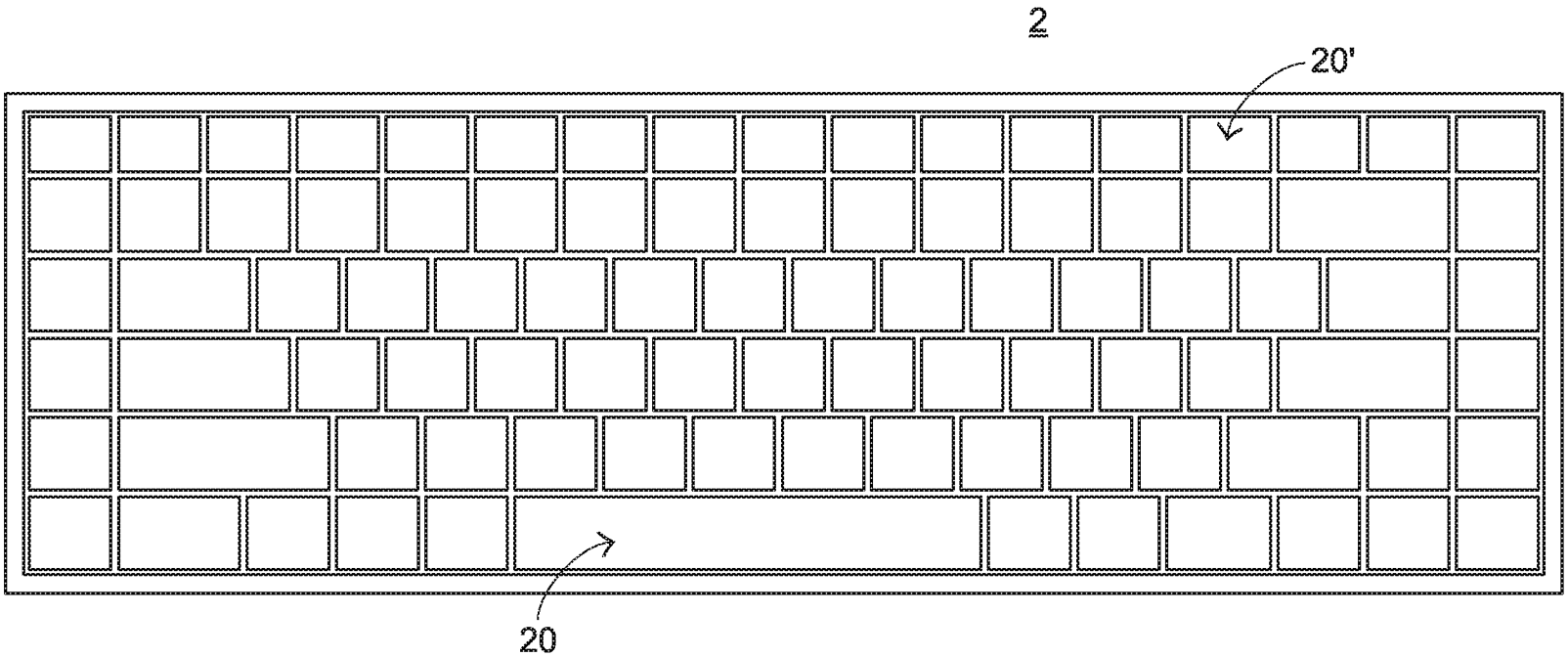
FIG. 5 is a schematic top view illustrating the outer appearance of a keyboard device according to a first embodiment of the present invention.
Figure 6:
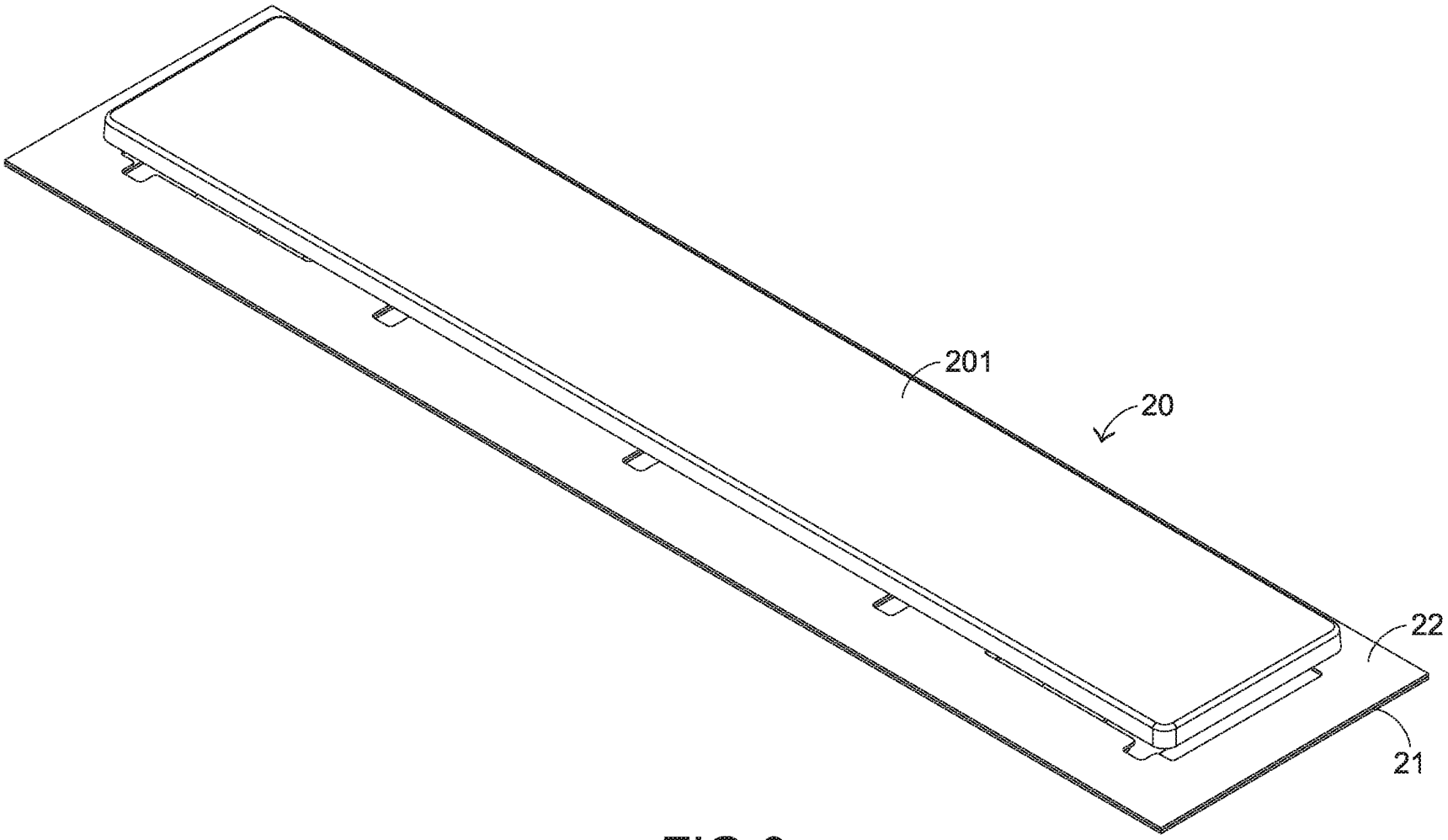
FIG. 6 is a schematic perspective view illustrating a key structure of the keyboard device as shown in FIG. 5.
Figure 7:
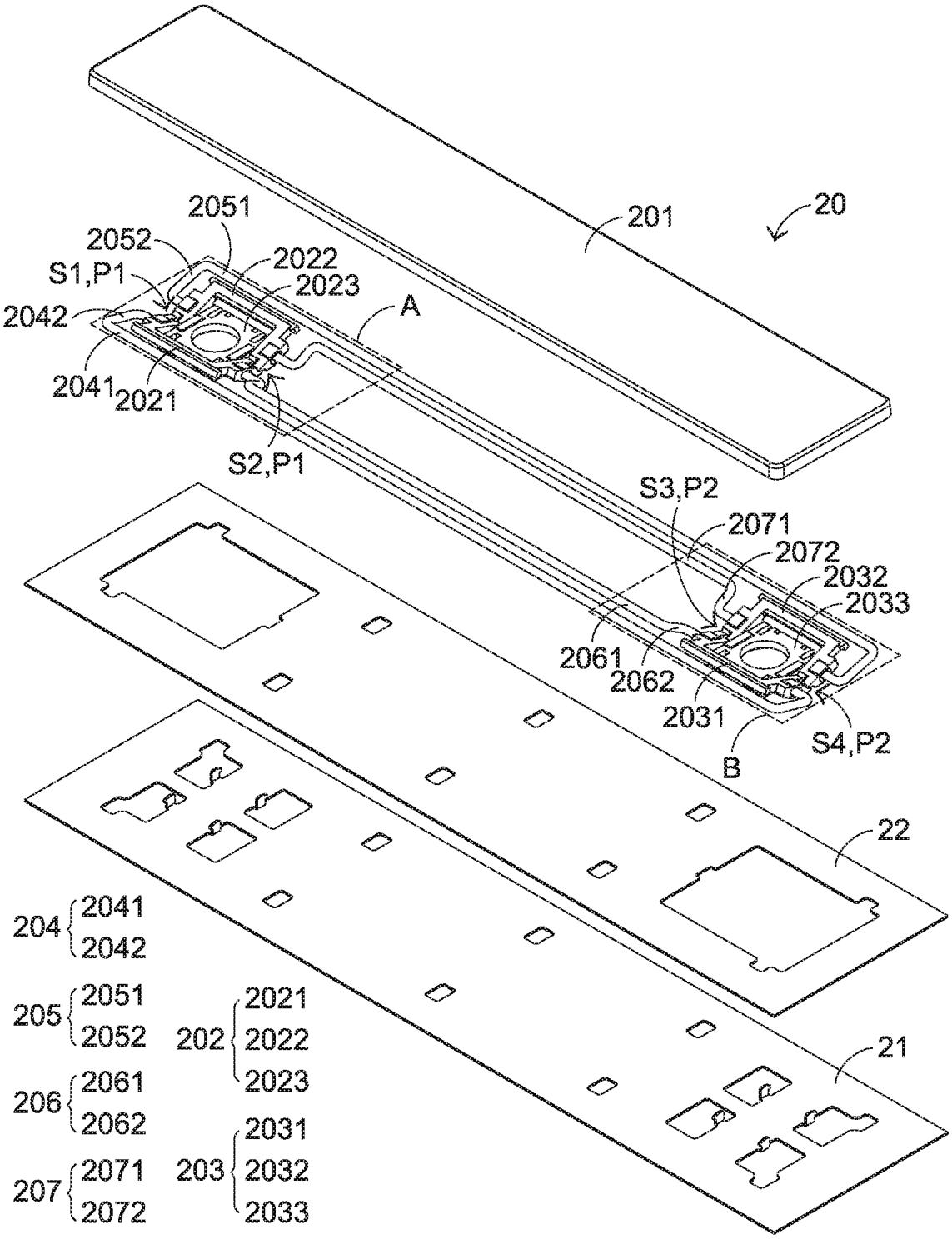
FIG. 7 is a schematic exploded view illustrating the key structure of the keyboard device as shown in FIG. 6.
Figure 8:
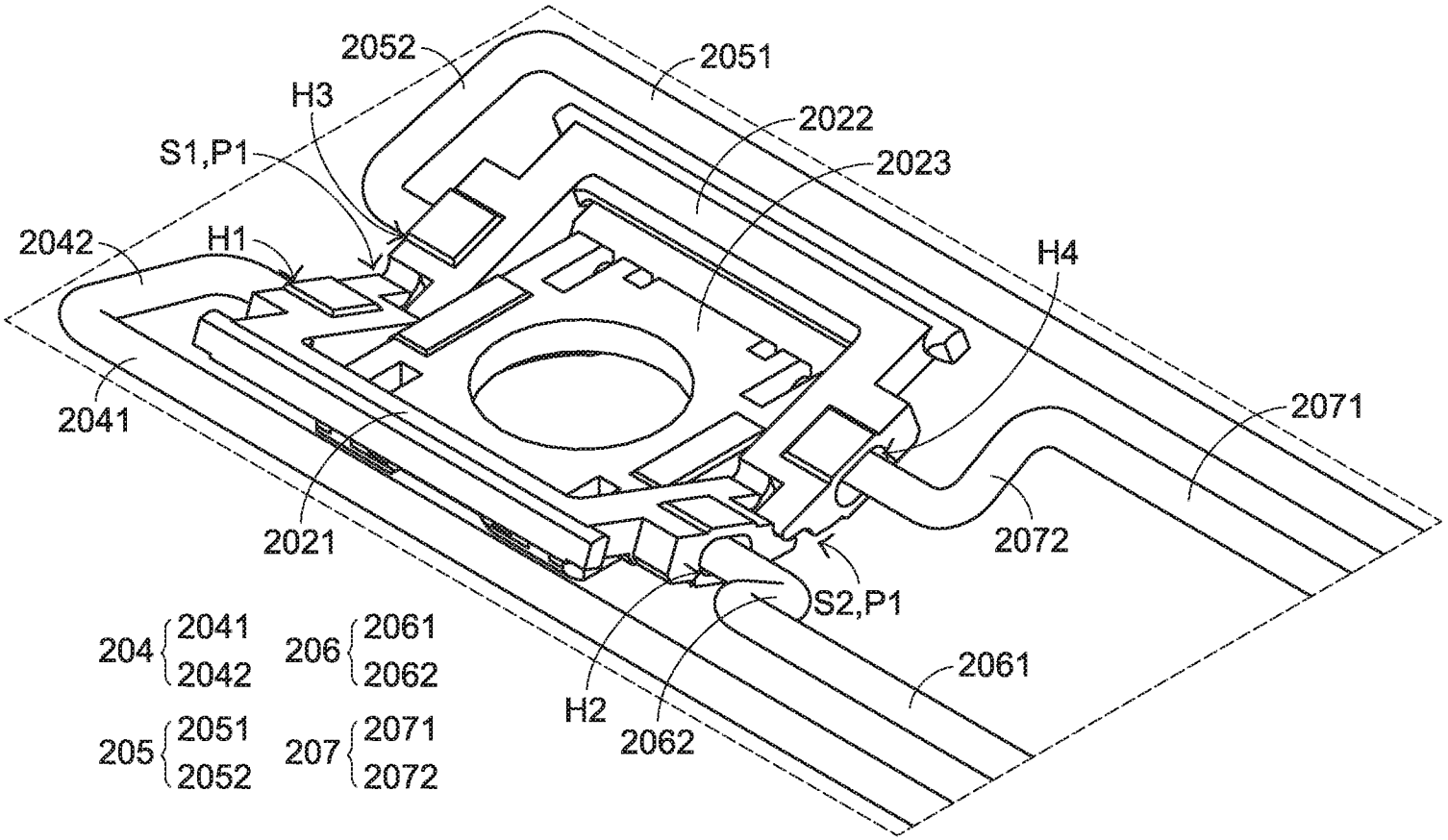
FIG. 8 is a schematic enlarged view illustrating the region A as shown in FIG. 7.
Figure 9:
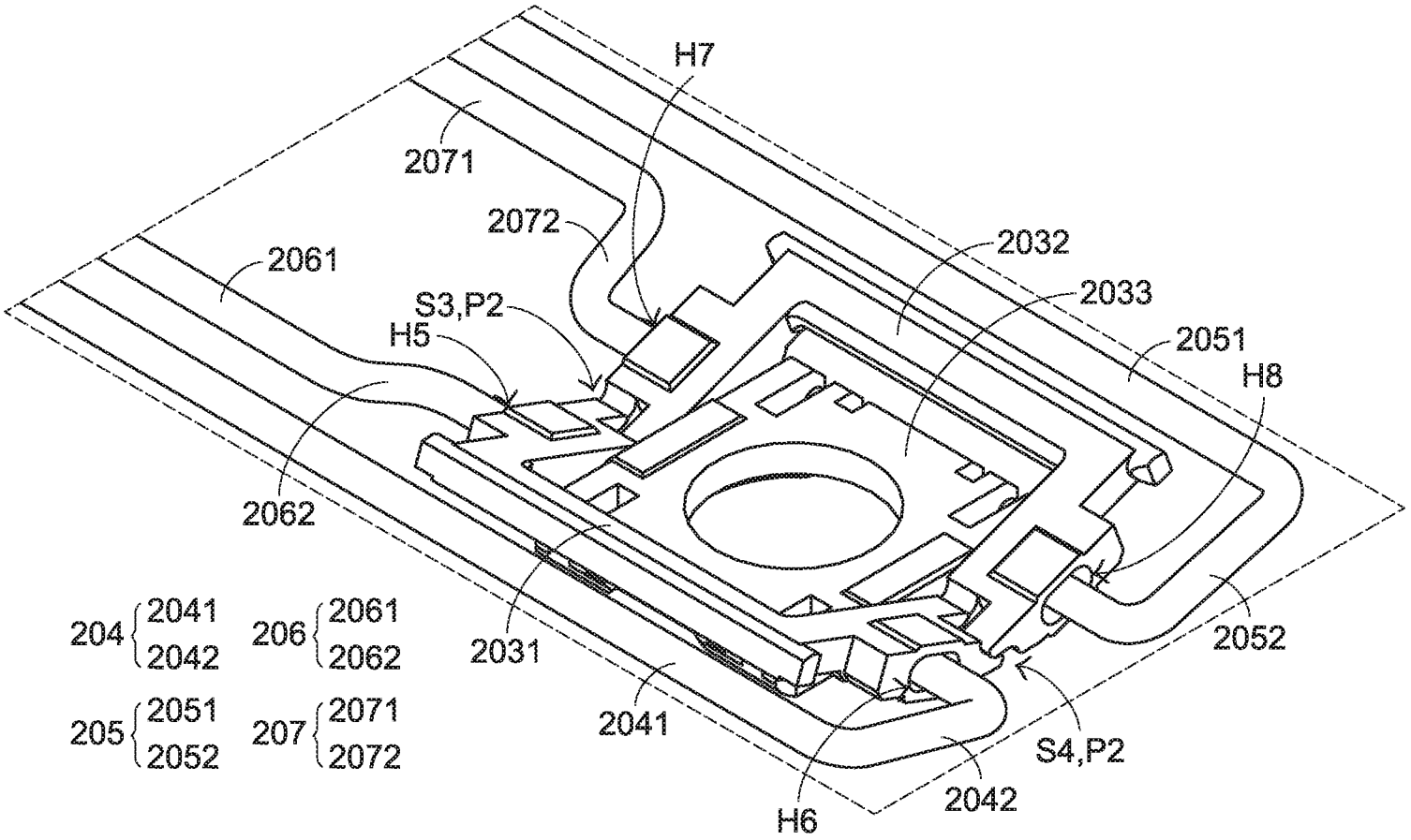
FIG. 9 is a schematic enlarged view illustrating the region B as shown in FIG. 7.

Please refer to FIGS. 5, 6, 7, 8 and 9. FIG. 5 is a schematic top view illustrating the outer appearance of a keyboard device according to a first embodiment of the present invention. FIG. 6 is a schematic perspective view illustrating a key structure of the keyboard device as shown in FIG. 5. FIG. 7 is a schematic exploded view illustrating the key structure of the keyboard device as shown in FIG. 6. FIG. 8 is a schematic enlarged view illustrating the region A as shown in FIG. 7. FIG. 9 is a schematic enlarged view illustrating the region B as shown in FIG. 7.

As shown in FIG. 5, the keyboard device 2 comprises plural key structures 20 and 20', a base plate 21 and a membrane circuit board 22. The membrane circuit board 22 is arranged between the plural keys 20, 20' and the base plate 21. The key structures 20' are classified into some types, e.g., ordinary keys, numeric keys and function keys. When one of the key structures 20' is depressed by the user's finger, the keyboard device 2 generates a corresponding key signal to a computer (not show), and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions. The key structure 20 is a Space key, a Shift key or any other similar multiple key with the larger area and length.

In the following embodiments, the key structure 20 of the keyboard device 2 will be described as follows. For succinctness, only one key structure 20 and related components are shown in the drawings.

Please refer to FIGS. 6, 7, 8 and 9. In this embodiment, the key structure 20 comprises a keycap 201, a first connecting element 202, a second connecting element 203, a first stabilizer bar 204, a second stabilizer bar 205, a first auxiliary bar 206 and a second auxiliary bar 207.

The keycap 201 is located over the membrane circuit board 22. The keycap 201 can be ascended or descended relative to the membrane circuit board 22.

The first connecting element 202 and the second connecting element 203 are arranged between the keycap 201 and the base plate 21. The first connecting element 202 is located at a first side of the base plate 21. The second connecting element 203 is located at a second side of the base plate 21. The first connecting element 202 has a first lateral side S1 and a second lateral side S2, which are opposed to each other. The second connecting element 203 has a third lateral side S3 and a fourth lateral side S4, which are opposed to each other. The second lateral side S2 of the first connecting element 202 and the third lateral side S3 of the second connecting element 203 face each other.

The first stabilizer bar 204 and the second stabilizer bar 205 are pivotally coupled to the keycap 201, the first lateral side S1 of the first connecting element 202 and the fourth lateral side S4 of the second connecting element 203. The first connecting element 202 and the second connecting element 203 are arranged between the first stabilizer bar 204 and the second stabilizer bar 205.

The first auxiliary bar 206 and the second auxiliary bar 207 are pivotally coupled to the keycap 201, the second lateral side S2 of the first connecting element 202 and the third lateral side S3 of the second connecting element 203. The first auxiliary bar 206 and the second auxiliary bar 207 are arranged between the first stabilizer bar 204 and the second stabilizer bar 205.

While the keycap 201 is moved downwardly or upwardly relative to the membrane circuit board 22, the first stabilizer bar 204, the second stabilizer bar 205, the first auxiliary bar 206 and the second auxiliary bar 207 are correspondingly swung with the keycap 201.

In this embodiment, the key structure 20 comprises two stabilizer bars (i.e., the first stabilizer bar 204 and the second stabilizer bar 205) and two auxiliary bars (i.e., the first auxiliary bar 206 and the second auxiliary bar 207). It is noted that the numbers of the stabilizer bars and the auxiliary bars are not restricted. In some other embodiments, the key structure comprises one or more than two stabilizer bars (i.e., the first stabilizer bar 204 and the second stabilizer bar 205) and one or more than two auxiliary bars. In this embodiment, the first connecting element 202 and the second connecting element 203 are butterfly-type connecting elements. It is noted that the types of the first connecting element 202 and the second connecting element 203 are not restricted. For example, in another embodiment, the first connecting element 202 and the second connecting element 203 are scissors-type connecting elements.

Please refer to FIGS. 6, 7, 8 and 9 again. The first connecting element 202 comprises a first frame 2021, a second frame 2022 and a first pedestal 2023. The first frame 2021 and the second frame 2022 are connected between the keycap 201 and the first pedestal 2023. The first pedestal 2023 is connected with the base plate 21. The first frame 2021 and the second frame 2022 are pivotally coupled to a first pivotal region P1. Moreover, the keycap 201 and the first pedestal 2023 have plural engaging structures (e.g., hooks). Due to the engaging structures, the keycap 201 and the first pedestal 2023 are connected with the first frame 2021 and the second frame 2022. The second connecting element 203 comprises a third frame 2031, a fourth frame 2032 and a second pedestal 2033. The third frame 2031 and the fourth frame 2032 are connected between the keycap 201 and the second pedestal 2033. The second pedestal 2033 is connected with the base plate 21. The third frame 2031 and the fourth frame 2032 are pivotally coupled to a second pivotal region P2. Moreover, the keycap 201 and the second pedestal 2033 have plural engaging structures (e.g., hooks). Due to the engaging structures, the keycap 201 and the second pedestal 2033 are connected with the third frame 2031 and the fourth frame 2032. While the keycap 201 is moved downwardly or upwardly relative to the membrane circuit board 22, the first frame 2021 and the second frame 2022 are correspondingly swung relative to the first pivotal region P1 (i.e., a fulcrum) and the third frame 2031 and the fourth frame 2032 are correspondingly swung relative to the second pivotal region P2 (i.e., a fulcrum).

In this embodiment, the first connecting element 202 and the second connecting element 203 are fixed on the base plate 21 through the first pedestal 2023 and the second pedestal 2033, respectively. In other words, while the first frame 2021, the second frame 2022, the third frame 2031 and the fourth frame 2032 are swung, the first pedestal 2023 and the second pedestal 2033 are not swung. Due to this structural design, the first pedestal 2023 and the second pedestal 2033 can be used to block the first frame 2021, the second frame 2022, the third frame 2031 and the fourth frame 2032 from the base plate 21. Consequently, while the first frame 2021, the second frame 2022, the third frame 2031 and the fourth frame 2032 are swung, the first frame 2021, the second frame 2022, the third frame 2031 and the fourth frame 2032 do not collide with the base plate 21 to generate the unpleasant sound.

Please refer to FIGS. 6, 7, 8 and 9 again. The first frame 2021 comprises a first sliding groove H1 and a second sliding groove H2, which are opposed to each other. The second frame 2022 comprises a third sliding groove H3 and a fourth sliding groove H4, which are opposed to each other. The first sliding groove H1 and the third sliding groove H3 are located at the first lateral side S1 of the first connecting element 202. The second sliding groove H2 and the fourth sliding groove H4 are located at the second lateral side S2 of the first connecting element 202. The third frame 2031 comprises a fifth sliding groove H5 and a sixth sliding groove H6, which are opposed to each other. The fourth frame 2032 comprises a seventh sliding groove H7 and an eighth sliding groove H8, which are opposed to each other. The fifth sliding groove H5 and the seventh sliding groove H7 are located at the third lateral side S3 of the second connecting element 203. The sixth sliding groove H6 and the eighth sliding groove H8 are located at the fourth lateral side S4 of the second connecting element 203.

The first stabilizer bar 204 is pivotally coupled to the first sliding groove H1 of the first frame 2021 and the sixth sliding groove H6 of the third frame 2031. The second stabilizer bar 205 is pivotally coupled to the third sliding groove H3 of the second frame 2022 and the eighth sliding groove H8 of the fourth frame 2032. The first auxiliary bar 206 is pivotally coupled to the second sliding groove H2 of the first frame 2021 and the fifth sliding groove H5 of the third frame 2031. The second auxiliary bar 207 is pivotally coupled to the fourth sliding groove H4 of the second frame 2022 and the seventh sliding groove H7 of the fourth frame 2032.

In an embodiment, the key structure comprises one stabilizer bar and one auxiliary bar. Under this circumstance, the stabilizer bar is pivotally coupled to the first sliding groove H1 of the first frame 2021 and the sixth sliding groove H6 of the third frame 2031, or pivotally coupled to the third sliding groove H3 of the second frame 2022 and the eighth sliding groove H8 of the fourth frame 2032. In addition, the auxiliary bar is pivotally coupled to the second sliding groove H2 of the first frame 2021 and the fifth sliding groove H5 of the third frame 2031, or pivotally coupled to the fourth sliding groove H4 of the second frame 2022 and the seventh sliding groove H7 of the fourth frame 2032.

Please refer to FIGS. 6, 7, 8 and 9 again. The first stabilizer bar 204 comprises a first transverse bar part 2041 and two first hook parts 2042. The first hook parts 2041 are located at two ends of the first transverse bar part 2041, respectively. The second stabilizer bar 205 comprises a second transverse bar part 2051 and two second hook parts 2052. The two second hook parts 2052 are located at two ends of the second transverse bar part 2051, respectively. The first auxiliary bar 206 comprises a third transverse bar part 2061 and two third hook parts 2062. The two third hook parts 2062 are located at two ends of the third transverse bar part 2061, respectively. The second auxiliary bar 207 comprises a fourth transverse bar part 2071 and two fourth hook parts 2072. The two fourth hook parts 2072 are located at two ends of the fourth transverse bar part 2071, respectively.

The first transverse bar part 2041 of the first stabilizer bar 204 is pivotally coupled to the keycap 201. The two first hook parts 2042 of the first stabilizer bar 204 are pivotally coupled to the first sliding groove H1 of the first frame 2021 and the sixth sliding groove H6 of the third frame 2031, respectively. The second transverse bar part 2051 of the second stabilizer bar 205 is pivotally coupled to the keycap 201. The two second hook parts 2052 of the second stabilizer bar 205 are pivotally coupled to the third sliding groove H3 of the second frame 2022 and the eighth sliding groove H8 of the fourth frame 2032. The third transverse bar part 2061 of the first auxiliary bar 206 is pivotally coupled to the keycap 201. The two third hook parts 2062 of the first auxiliary bar 206 are pivotally coupled to the second sliding groove H2 of the first frame 2021 and the fifth sliding groove H5 of the third frame 2031. The fourth transverse bar part 2071 of the second auxiliary bar 207 is pivotally coupled to the keycap 201. The two fourth hook parts 2072 of the second auxiliary bar 207 are pivotally coupled to the fourth sliding groove H4 of the second frame 2022 and the seventh sliding groove H7 of the fourth frame 2032.

Figure 10A:
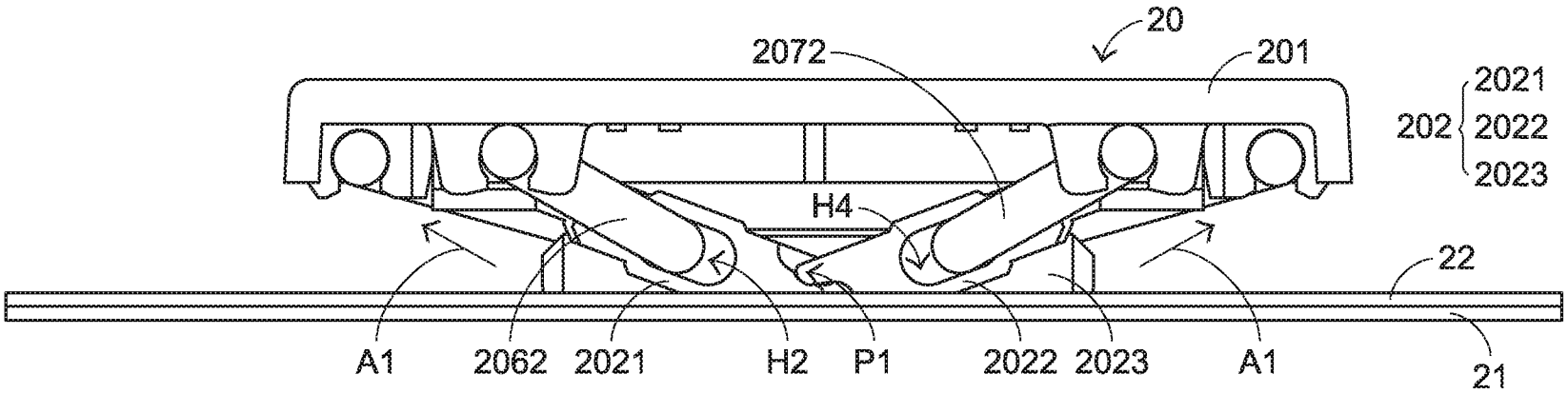
FIG. 10A schematically illustrates the relationships between the first auxiliary bar, the second auxiliary bar, the second sliding groove and the fourth sliding groove when the keycap of the key structure as shown in FIG. 6 is not depressed.
Figure 10B:
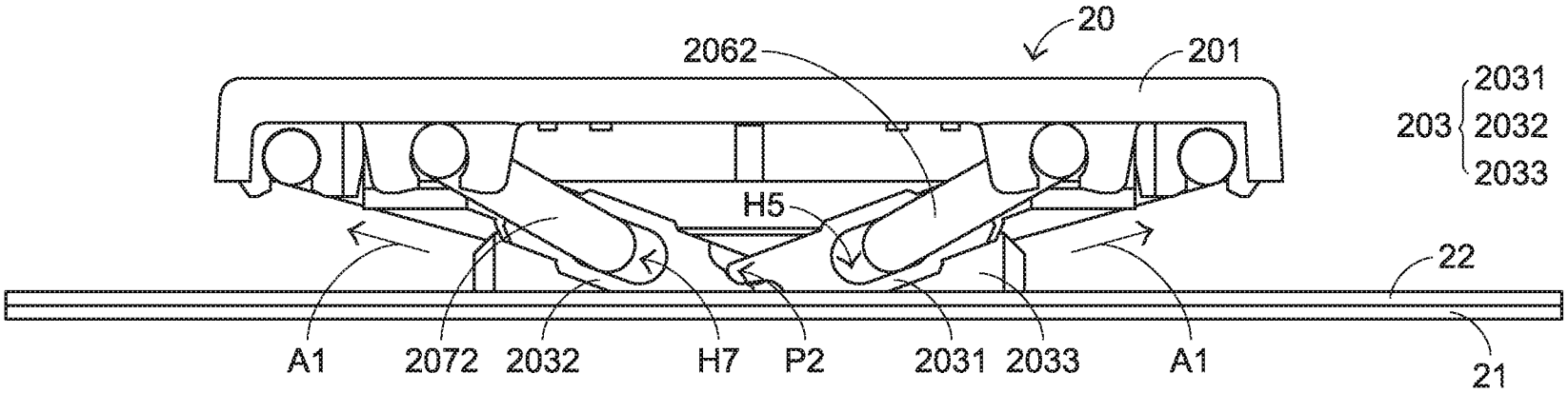
FIG. 10B schematically illustrates the relationships between the first auxiliary bar, the second auxiliary bar, the fifth sliding groove and the seventh sliding groove when the keycap of the key structure as shown in FIG. 6 is not depressed.
Figure 10C:
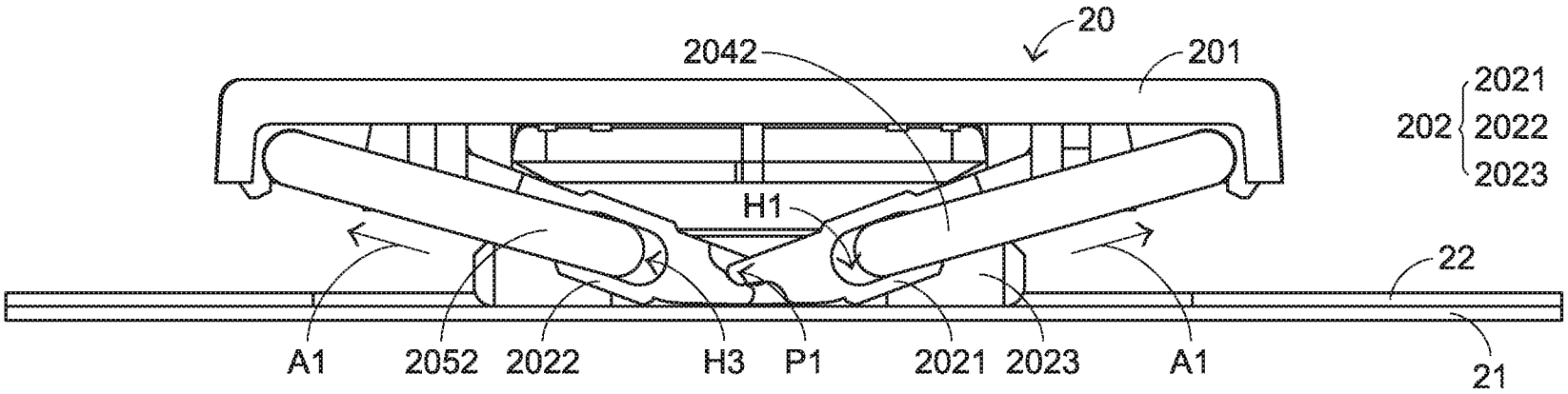
FIG. 10C schematically illustrates the relationships between the first stabilizer bar, the second stabilizer bar, the first sliding groove and the third sliding groove when the keycap of the key structure as shown in FIG. 6 is not depressed.
Figure 10D:
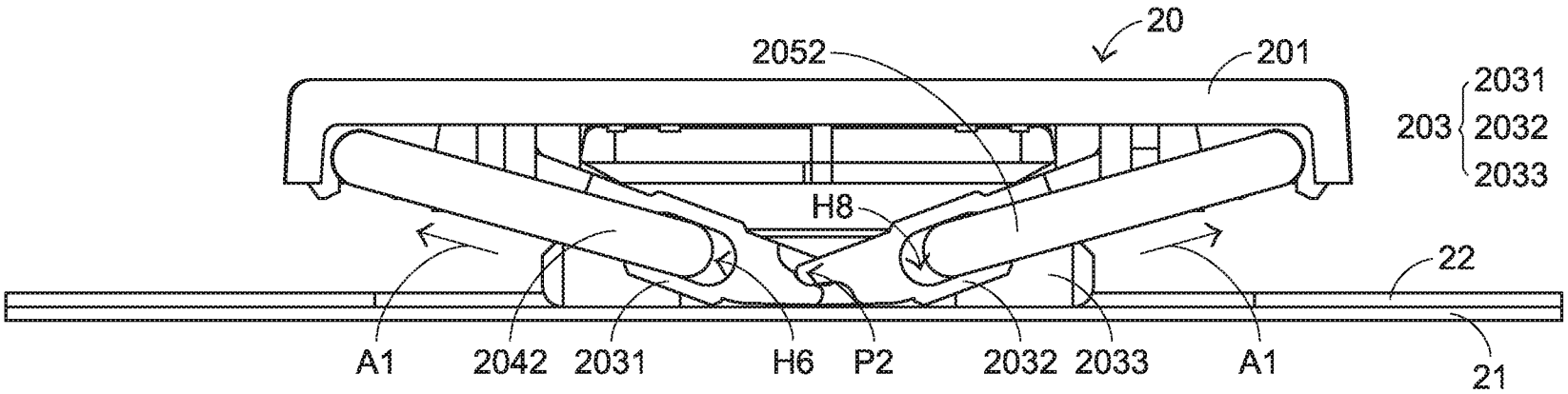
FIG. 10D schematically illustrates the relationships between the first stabilizer bar, the second stabilizer bar, the sixth sliding groove and the eighth sliding groove when the keycap of the key structure as shown in FIG. 6 is not depressed.

Please refer to FIGS. 10A, 10B, 10C and 10D. FIG. 10A schematically illustrates the relationships between the first auxiliary bar, the second auxiliary bar, the second sliding groove and the fourth sliding groove when the keycap of the key structure as shown in FIG. 6 is not depressed. FIG. 10B schematically illustrates the relationships between the first auxiliary bar, the second auxiliary bar, the fifth sliding groove and the seventh sliding groove when the keycap of the key structure as shown in FIG. 6 is not depressed. FIG. 10C schematically illustrates the relationships between the first stabilizer bar, the second stabilizer bar, the first sliding groove and the third sliding groove when the keycap of the key structure as shown in FIG. 6 is not depressed. FIG. 10D schematically illustrates the relationships between the first stabilizer bar, the second stabilizer bar, the sixth sliding groove and the eighth sliding groove when the keycap of the key structure as shown in FIG. 6 is not depressed.

While the keycap 201 is moved upwardly relative to the membrane circuit board 22, the keycap 201 is switched from a depressed state to an undepressed state. As the keycap 201 is moved upwardly, the first stabilizer bar 204, the second stabilizer bar 205, the first auxiliary bar 206 and the second auxiliary bar 207 are correspondingly swung. As shown in FIGS. 10A and 10B, the two third hook parts 2062 of the first auxiliary bar 206 are moved within the second sliding groove H2 of the first frame 2021 and the fifth sliding groove H5 of the third frame 2031 along the directions away from the first pivotal region P1 and the second pivotal region P2 (e.g., along the direction indicated by the arrow A1). In addition, the two fourth hook parts 2072 of the second auxiliary bar 207 are moved within the fourth sliding groove H4 of the second frame 2022 and the seventh sliding groove H7 of the fourth frame 2032 along the directions away from the first pivotal region P1 and the second pivotal region P2 (e.g., along the direction indicated by the arrow A1). As shown in FIGS. 10C and 10D, the two first hook parts 2042 of the first stabilizer bar 204 are moved within the first sliding groove H1 of the first frame 2021 and the sixth sliding groove H6 of the third frame 2031 along the directions away from the first pivotal region P1 and the second pivotal region P2 (e.g., along the direction indicated by the arrow A1). In addition, the two second hook parts 2052 of the second stabilizer bar 205 are moved within the third sliding groove H3 of the second frame 2022 and the eighth sliding groove H8 of the fourth frame 2032 along the directions away from the first pivotal region P1 and the second pivotal region P2 (e.g., along the direction indicated by the arrow A1).

Figure 11A:
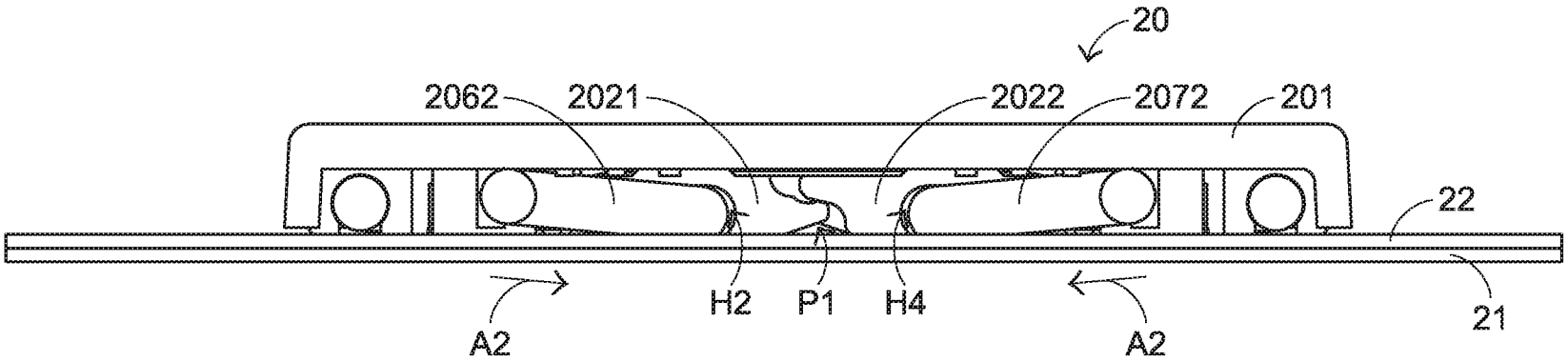
FIG. 11A schematically illustrates the relationships between the first auxiliary bar, the second auxiliary bar, the second sliding groove and the fourth sliding groove when the keycap of the key structure as shown in FIG. 6 is depressed.
Figure 11B:
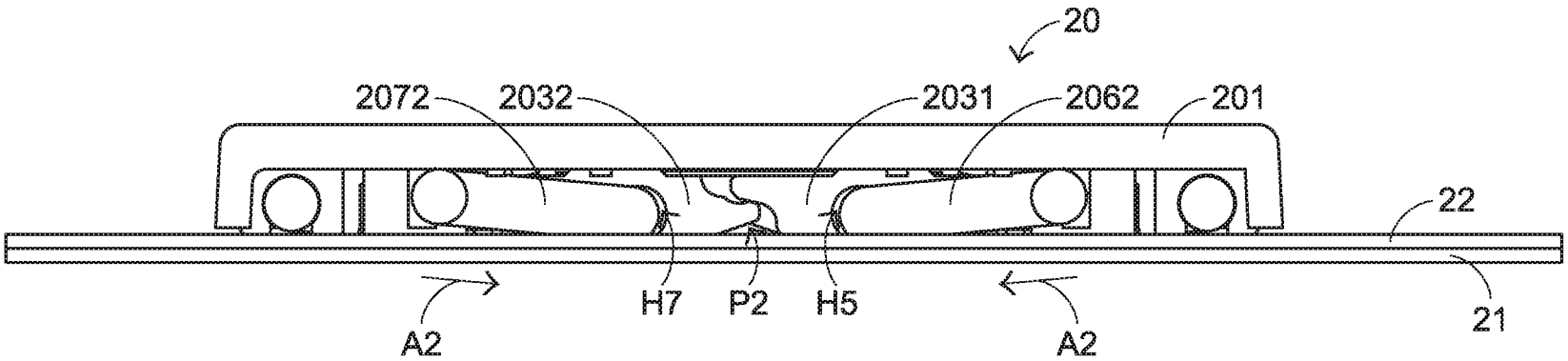
FIG. 11B schematically illustrates the relationships between the first auxiliary bar, the second auxiliary bar, the fifth sliding groove and the seventh sliding groove when the keycap of the key structure as shown in FIG. 6 is depressed.
Figure 11C:
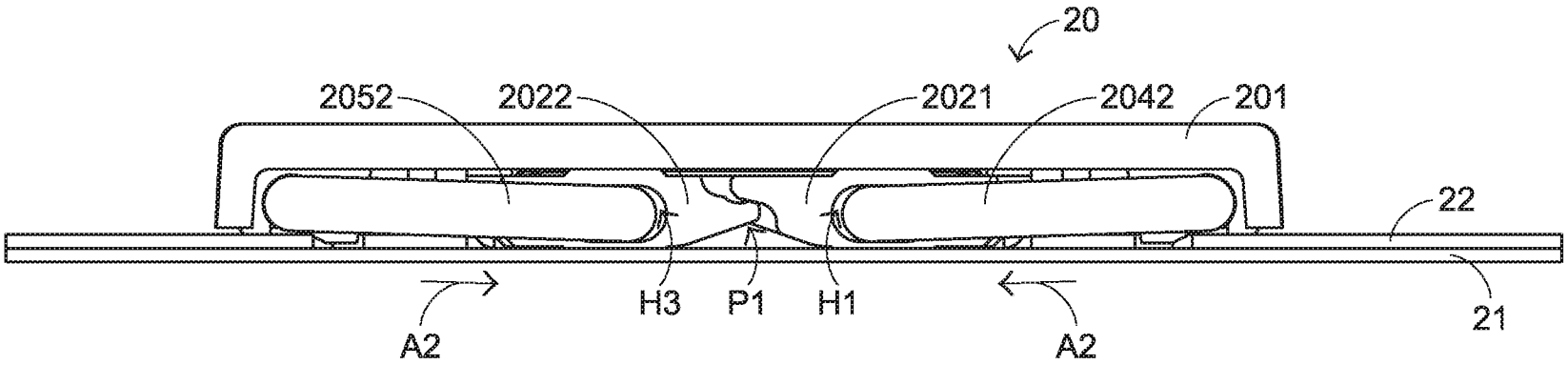
FIG. 11C schematically illustrates the relationships between the first stabilizer bar, the second stabilizer bar, the first sliding groove and the third sliding groove when the keycap of the key structure as shown in FIG. 6 is depressed.
Figure 11D:
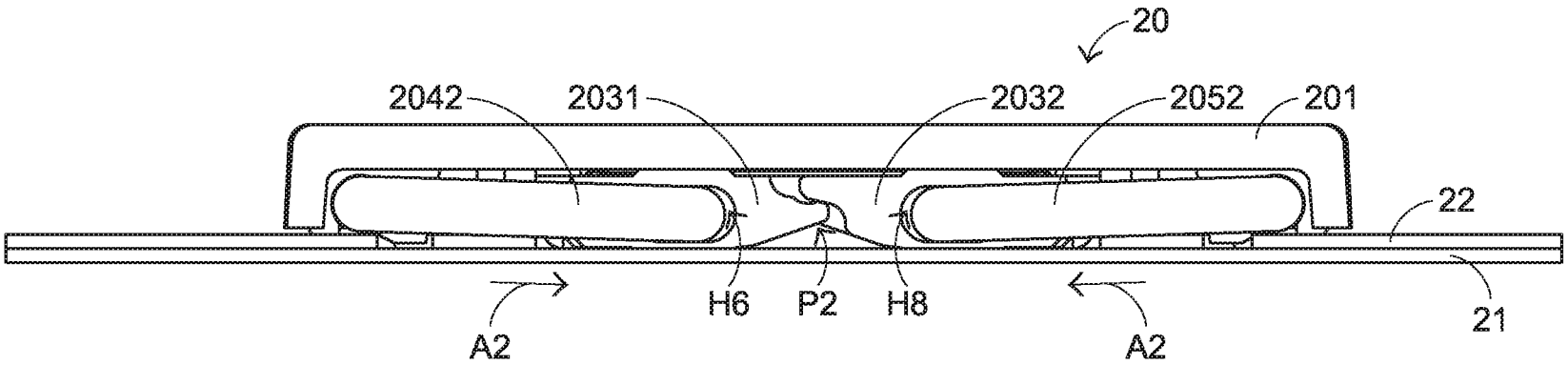
FIG. 11D schematically illustrates the relationships between the first stabilizer bar, the second stabilizer bar, the sixth sliding groove and the eighth sliding groove when the keycap of the key structure as shown in FIG. 6 is depressed.

Please refer to FIGS. 11A, 11B, 11C and 11D. FIG. 11A schematically illustrates the relationships between the first auxiliary bar, the second auxiliary bar, the second sliding groove and the fourth sliding groove when the keycap of the key structure as shown in FIG. 6 is depressed. FIG. 11B schematically illustrates the relationships between the first auxiliary bar, the second auxiliary bar, the fifth sliding groove and the seventh sliding groove when the keycap of the key structure as shown in FIG. 6 is depressed. FIG. 11C schematically illustrates the relationships between the first stabilizer bar, the second stabilizer bar, the first sliding groove and the third sliding groove when the keycap of the key structure as shown in FIG. 6 is depressed. FIG. 11D schematically illustrates the relationships between the first stabilizer bar, the second stabilizer bar, the sixth sliding groove and the eighth sliding groove when the keycap of the key structure as shown in FIG. 6 is depressed.

While the keycap 201 is moved downwardly relative to the membrane circuit board 22, the keycap 201 is switched from the undepressed state to the depressed state. As the keycap 201 is moved downwardly, the first stabilizer bar 204, the second stabilizer bar 205, the first auxiliary bar 206 and the second auxiliary bar 207 are correspondingly swung. As shown in FIGS. 11A and 11B, the two third hook parts 2062 of the first auxiliary bar 206 are moved within the second sliding groove H2 of the first frame 2021 and the fifth sliding groove H5 of the third frame 2031 along the directions toward the first pivotal region P1 and the second pivotal region P2 (e.g., along the direction indicated by the arrow A2). In addition, the two fourth hook parts 2072 of the second auxiliary bar 207 are moved within the fourth sliding groove H4 of the second frame 2022 and the seventh sliding groove H7 of the fourth frame 2032 along the directions toward the first pivotal region P1 and the second pivotal region P2 (e.g., along the direction indicated by the arrow A2). As shown in FIGS. 11C and 11D, the two first hook parts 2042 of the first stabilizer bar 204 are moved within the first sliding groove H1 of the first frame 2021 and the sixth sliding groove H6 of the third frame 2031 along the directions toward the first pivotal region P1 and the second pivotal region P2 (e.g., along the direction indicated by the arrow A2). In addition, the two second hook parts 2052 of the second stabilizer bar 205 are moved within the third sliding groove H3 of the second frame 2022 and the eighth sliding groove H8 of the fourth frame 2032 along the directions toward the first pivotal region P1 and the second pivotal region P2 (e.g., along the direction indicated by the arrow A2).

Figure 12:
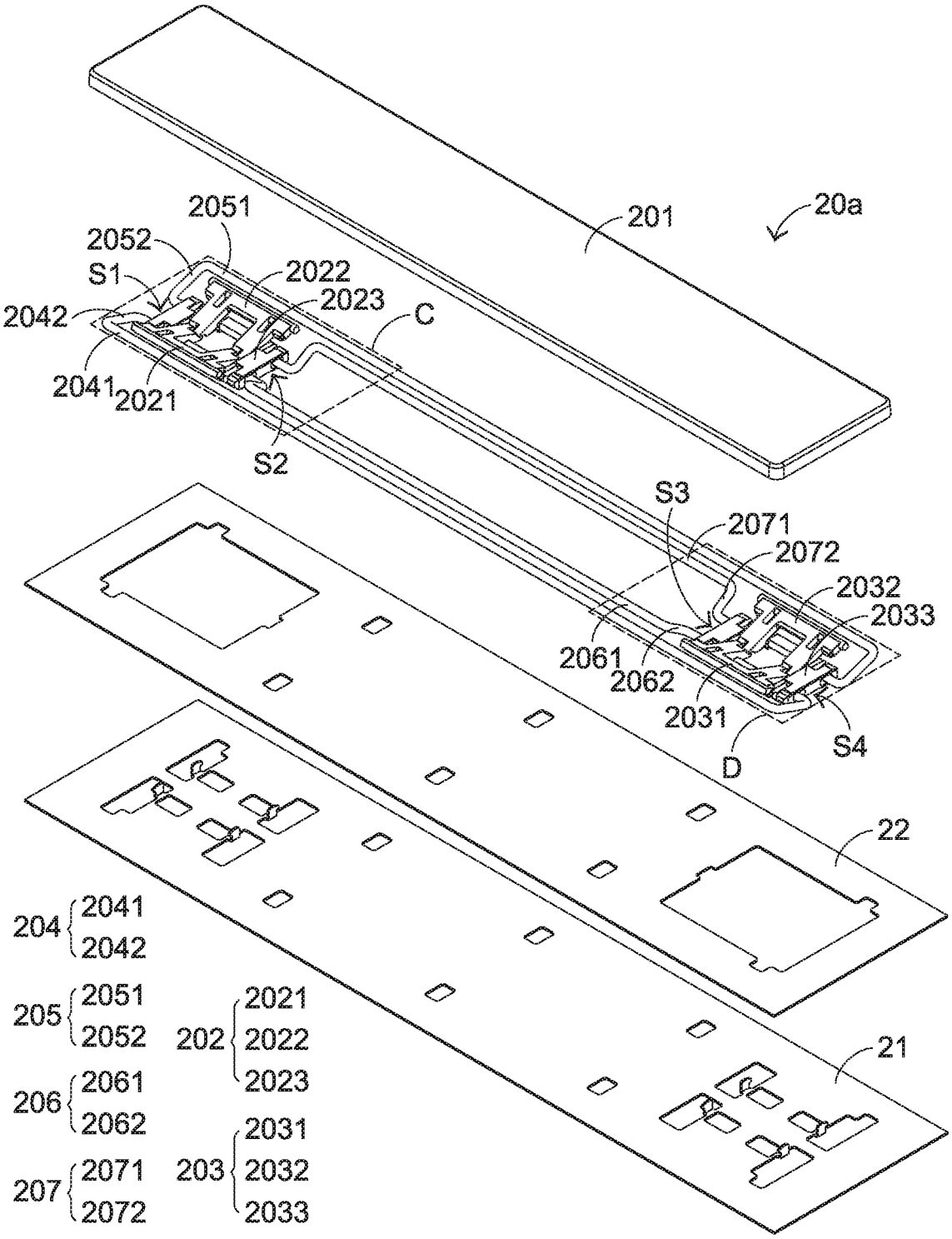
FIG. 12 is a schematic exploded view illustrating a key structure of a keyboard device according to a second embodiment of the present invention.
Figure 13:
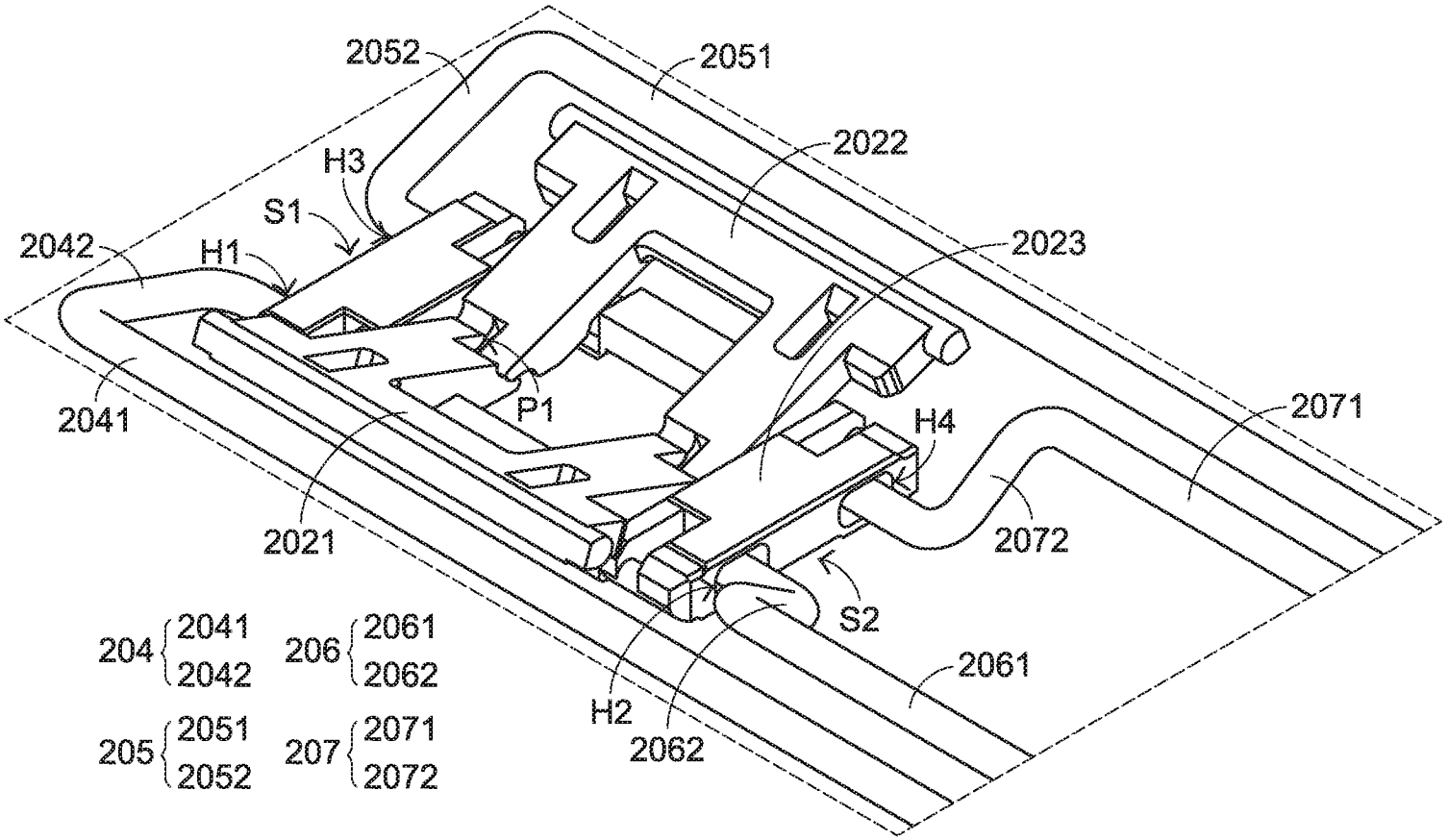
FIG. 13 is a schematic enlarged view illustrating the region C as shown in FIG. 12.
Figure 14:
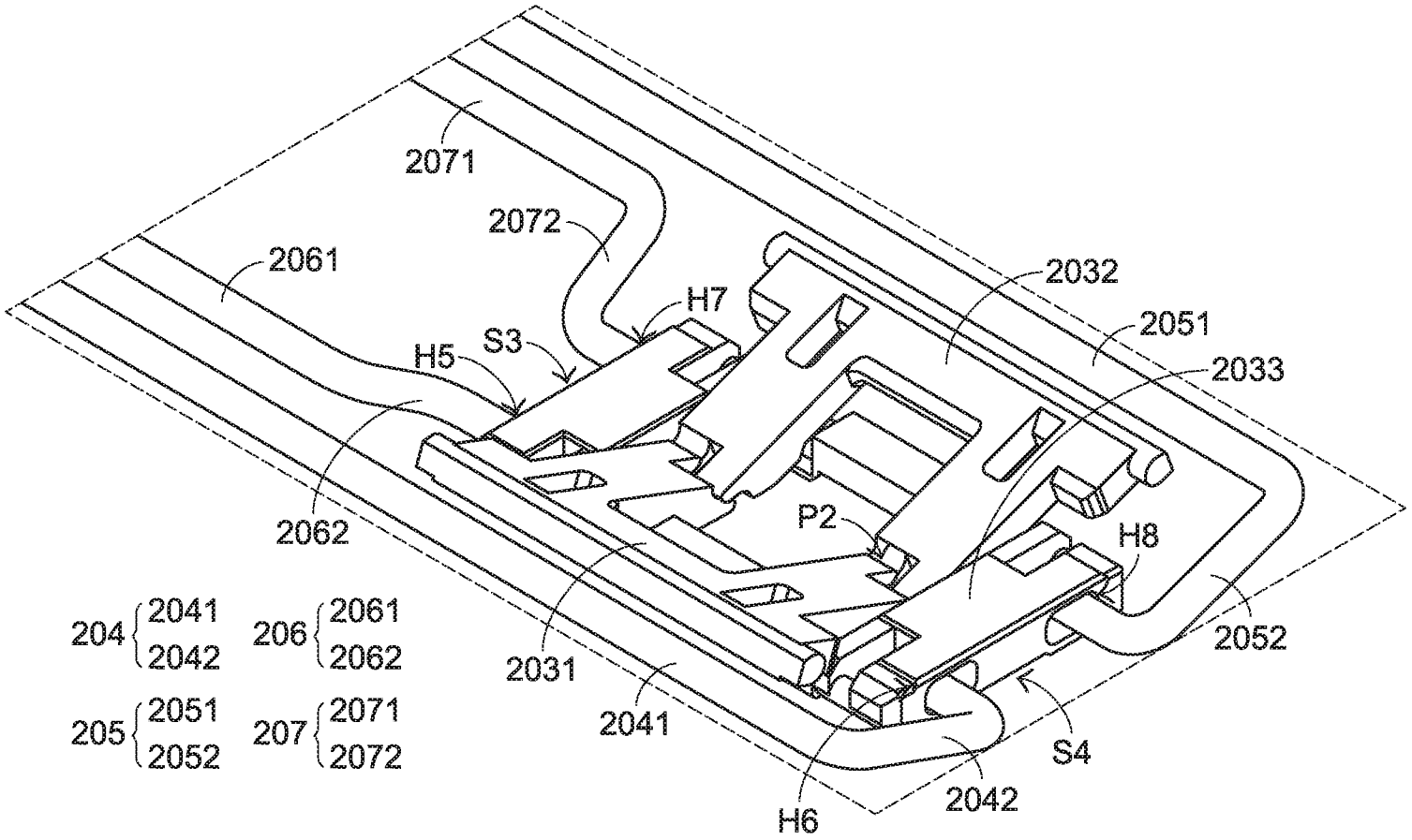
FIG. 14 is a schematic enlarged view illustrating the region D as shown in FIG. 12.

Please refer to FIGS. 12, 13 and 14. FIG. 12 is a schematic exploded view illustrating a key structure of a keyboard device according to a second embodiment of the present invention. FIG. 13 is a schematic enlarged view illustrating the region C as shown in FIG. 12. FIG. 14 is a schematic enlarged view illustrating the region D as shown in FIG. 12.

In comparison with the key structure 20 as shown in FIGS. 5, 6 and 7, the positions of the sliding grooves in the key structure 20*a* of this embodiment are distinguished. In this embodiment, the first sliding groove H1, the second sliding groove H2, the third sliding groove H3 and the fourth sliding groove H4 are formed in the first pedestal 2023 of the first connecting element 202, and the fifth sliding groove H5, the sixth sliding groove H6, the seventh sliding groove H7 and the eighth sliding groove H8 are formed in the second pedestal 2033 of the second connecting element 203. The first sliding groove H1 and the third sliding groove H3 of the first pedestal 2023 are located at the first lateral side S1 of the first connecting element 202. The second sliding groove H2 and the fourth sliding groove H4 of the first pedestal 2023 are located at the second lateral side S2 of the first connecting element 202. The fifth sliding groove H5 and the seventh sliding groove H7 of the second pedestal 2033 are located at the third lateral side S3 of the second connecting element 203. The sixth sliding groove H6 and the eighth sliding groove H8 of the second pedestal 2033 are located at the fourth lateral side S4 of the second connecting element 203.

The two first hook parts 2042 of the first stabilizer bar 204 are pivotally coupled to the first sliding groove H1 of the first pedestal 2023 and the sixth sliding groove H6 of the second pedestal 2033, respectively. The two second hook parts 2052 of the second stabilizer bar 205 are pivotally coupled to the third sliding groove H3 of the first pedestal 2023 and the eighth sliding groove H8 of the second pedestal 2033. The two third hook parts 2062 of the first auxiliary bar 206 are pivotally coupled to the second sliding groove H2 of the first pedestal 2023 and the fifth sliding groove H5 of the second pedestal 2033. The two fourth hook parts 2072 of the second auxiliary bar 207 are pivotally coupled to the fourth sliding groove H4 of the first pedestal 2023 and the seventh sliding groove H7 of the second pedestal 2033.

In this embodiment, the first connecting element 202 and the second connecting element 203 are butterfly-type connecting elements. It is noted that the types of the first connecting element 202 and the second connecting element 203 are not restricted.

In this embodiment, the first connecting element 202 and the second connecting element 203 are fixed on the base plate 21 through the first pedestal 2023 and the second pedestal 2033, respectively. In other words, while the first frame 2021, the second frame 2022, the third frame 2031 and the fourth frame 2032 are swung, the first pedestal 2023 and the second pedestal 2033 are not swung. Due to this structural design, the stabilizer bars and the auxiliary bars installed on the first pedestal and the second pedestal can acquire enhanced supporting forces.

Figure 15A:
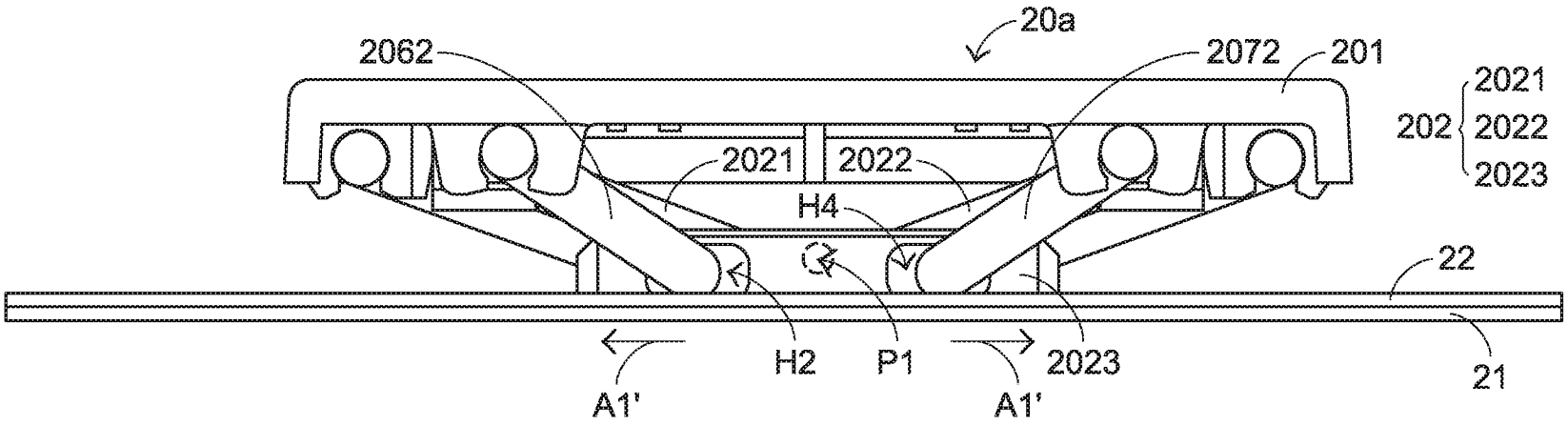
FIG. 15A schematically illustrates the relationships between the first auxiliary bar, the second auxiliary bar, the second sliding groove and the fourth sliding groove when the keycap of the key structure as shown in FIG. 12 is not depressed.
Figure 15B:
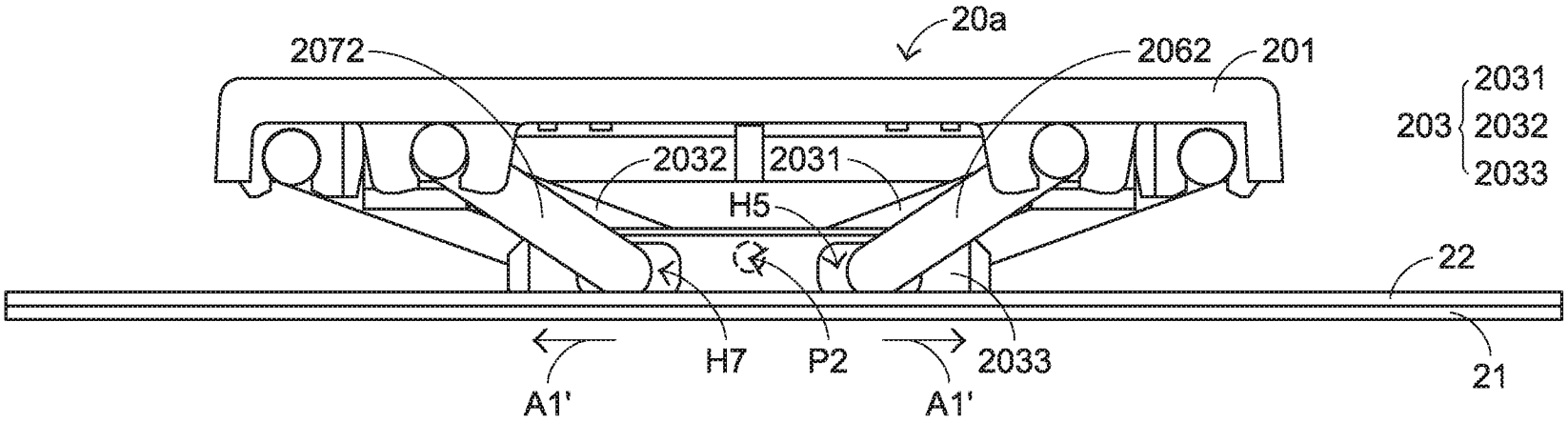
FIG. 15B schematically illustrates the relationships between the first auxiliary bar, the second auxiliary bar, the fifth sliding groove and the seventh sliding groove when the keycap of the key structure as shown in FIG. 12 is not depressed.
Figure 15C:
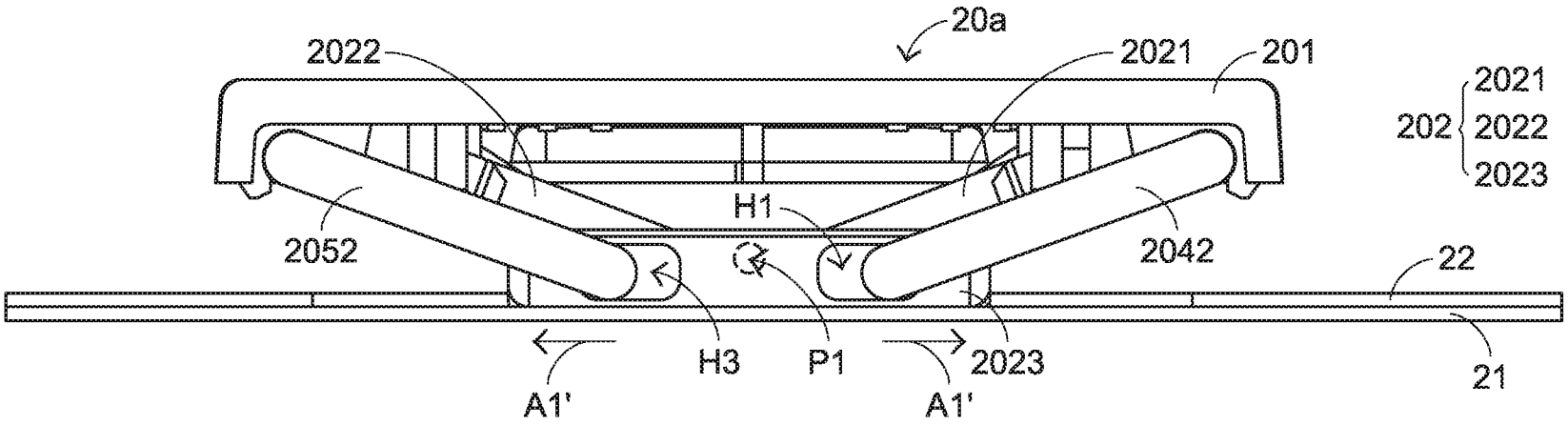
FIG. 15C schematically illustrates the relationships between the first stabilizer bar, the second stabilizer bar, the first sliding groove and the third sliding groove when the keycap of the key structure as shown in FIG. 12 is not depressed.
Figure 15D:
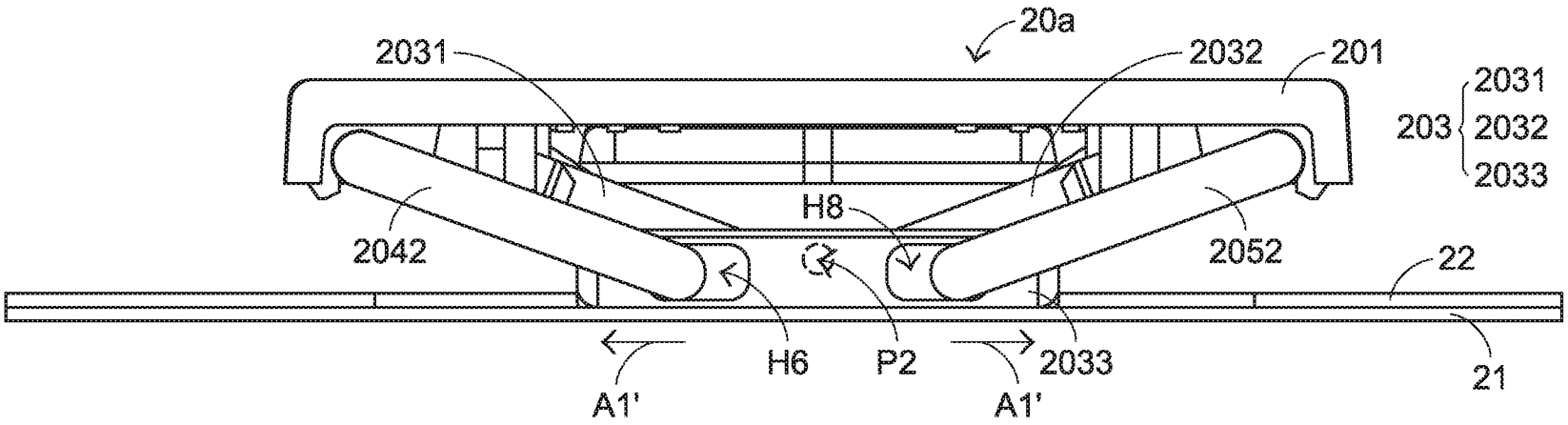
FIG. 15D schematically illustrates the relationships between the first stabilizer bar, the second stabilizer bar, the sixth sliding groove and the eighth sliding groove when the keycap of the key structure as shown in FIG. 12 is not depressed.

Please refer to FIGS. 15A, 15B, 15C and 15D. FIG. 15A schematically illustrates the relationships between the first auxiliary bar, the second auxiliary bar, the second sliding groove and the fourth sliding groove when the keycap of the key structure as shown in FIG. 12 is not depressed. FIG. 15B schematically illustrates the relationships between the first auxiliary bar, the second auxiliary bar, the fifth sliding groove and the seventh sliding groove when the keycap of the key structure as shown in FIG. 12 is not depressed. FIG. 15C schematically illustrates the relationships between the first stabilizer bar, the second stabilizer bar, the first sliding groove and the third sliding groove when the keycap of the key structure as shown in FIG. 12 is not depressed. FIG. 15D schematically illustrates the relationships between the first stabilizer bar, the second stabilizer bar, the sixth sliding groove and the eighth sliding groove when the keycap of the key structure as shown in FIG. 12 is not depressed.

While the keycap 201 of the key structure 20*a* is moved upwardly relative to the membrane circuit board 22, the keycap 201 is switched from a depressed state to an undepressed state. As the keycap 201 is moved upwardly, the first stabilizer bar 204, the second stabilizer bar 205, the first auxiliary bar 2012 and the second auxiliary bar 207 are correspondingly swung. As shown in FIGS. 15A and 15B, the two third hook parts 2062 of the first auxiliary bar 206 are moved within the second sliding groove H2 of the first pedestal 2023 and the fifth sliding groove H5 of the second pedestal 2033 along the directions away from the first pivotal region P1 and the second pivotal region P2 (e.g., along the direction indicated by the arrow A1'). In addition, the two fourth hook parts 2072 of the second auxiliary bar 207 are moved within the fourth sliding groove H4 of the first pedestal 2023 and the seventh sliding groove H7 of the second pedestal 2033 along the directions away from the first pivotal region P1 and the second pivotal region P2 (e.g., along the direction indicated by the arrow A1'). As shown in FIGS. 15C and 15D, the two first hook parts 2042 of the first stabilizer bar 204 are moved within the first sliding groove H1 of the first pedestal 2023 and the sixth sliding groove H6 of the second pedestal 2033 along the directions away from the first pivotal region P1 and the second pivotal region P2 (e.g., along the direction indicated by the arrow A1'). In addition, the two second hook parts 2052 of the second stabilizer bar 205 are moved within the third sliding groove H3 of the first pedestal 2023 and the eighth sliding groove H8 of the second pedestal 2033 along the directions away from the first pivotal region P1 and the second pivotal region P2 (e.g., along the direction indicated by the arrow A1').

Figure 16A:
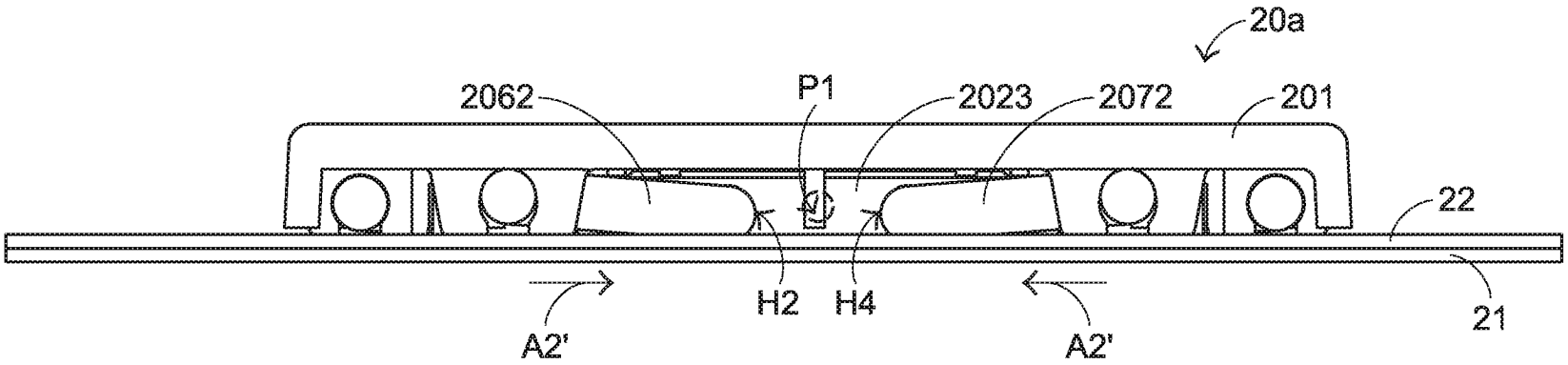
FIG. 16A schematically illustrates the relationships between the first auxiliary bar, the second auxiliary bar, the second sliding groove and the fourth sliding groove when the keycap of the key structure as shown in FIG. 12 is depressed.
Figure 16B:
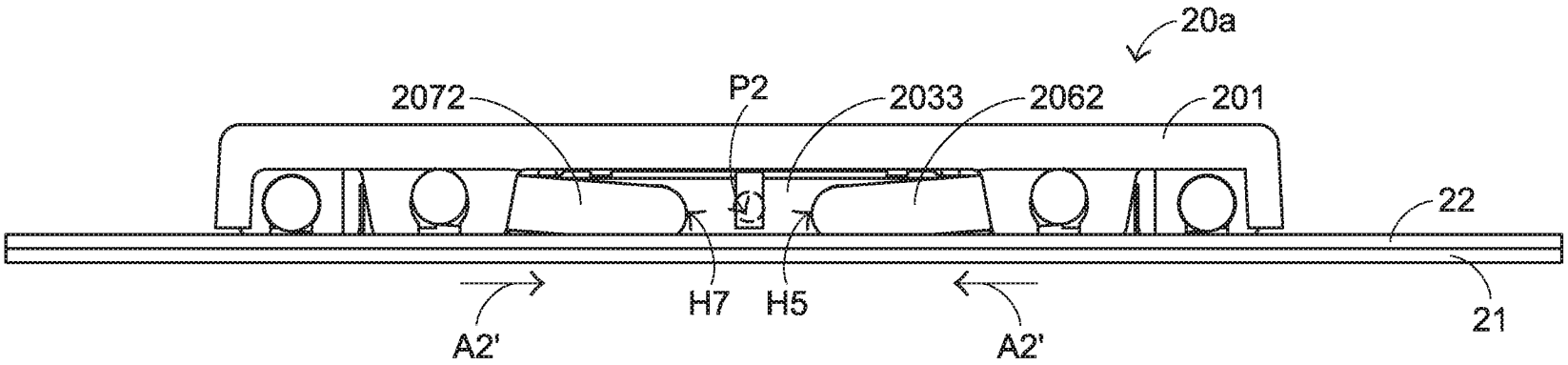
FIG. 16B schematically illustrates the relationships between the first auxiliary bar, the second auxiliary bar, the fifth sliding groove and the seventh sliding groove when the keycap of the key structure as shown in FIG. 12 is depressed.
Figure 16C:
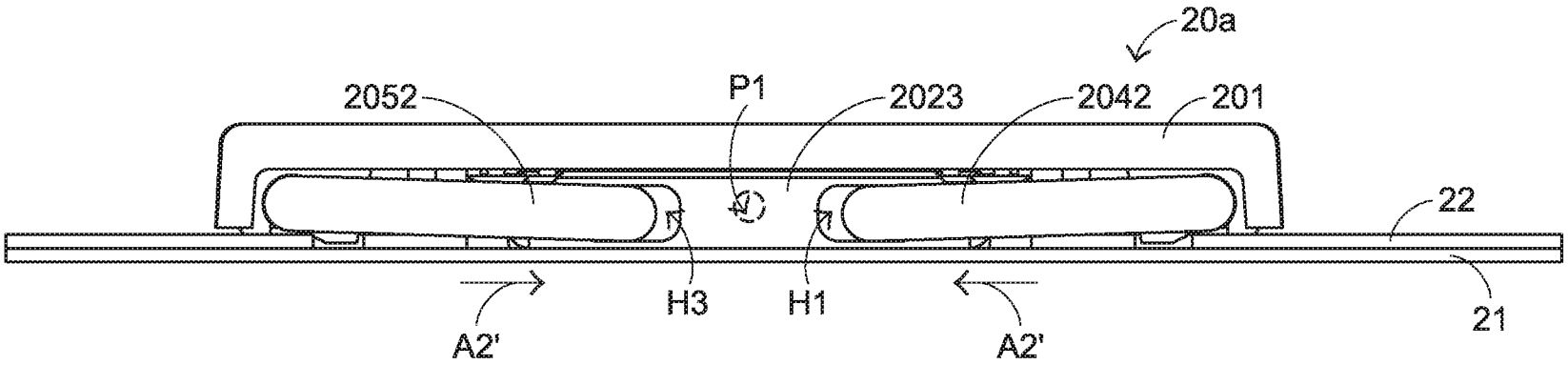
FIG. 16C schematically illustrates the relationships between the first stabilizer bar, the second stabilizer bar, the first sliding groove and the third sliding groove when the keycap of the key structure as shown in FIG. 12 is depressed.
Figure 16D:
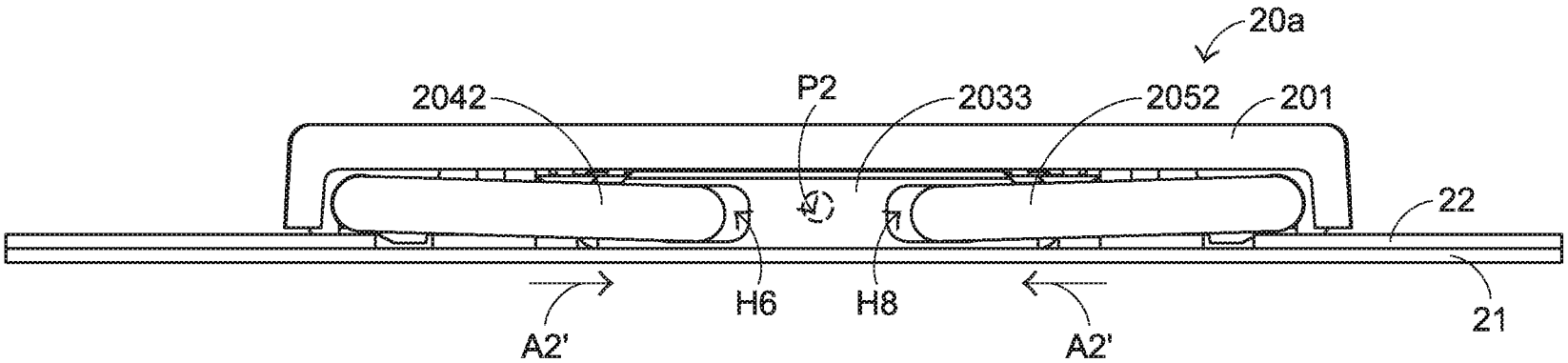
FIG. 16D schematically illustrates the relationships between the first stabilizer bar, the second stabilizer bar, the sixth sliding groove and the eighth sliding groove when the keycap of the key structure as shown in FIG. 12 is depressed.

Please refer to FIGS. 16A, 16B, 16C and 16D. FIG. 16A schematically illustrates the relationships between the first auxiliary bar, the second auxiliary bar, the second sliding groove and the fourth sliding groove when the keycap of the key structure as shown in FIG. 12 is depressed. FIG. 16B schematically illustrates the relationships between the first auxiliary bar, the second auxiliary bar, the fifth sliding groove and the seventh sliding groove when the keycap of the key structure as shown in FIG. 12 is depressed. FIG. 16C schematically illustrates the relationships between the first stabilizer bar, the second stabilizer bar, the first sliding groove and the third sliding groove when the keycap of the key structure as shown in FIG. 12 is depressed. FIG. 16D schematically illustrates the relationships between the first stabilizer bar, the second stabilizer bar, the sixth sliding groove and the eighth sliding groove when the keycap of the key structure as shown in FIG. 12 is depressed.

While the keycap 201 of the key structure 20*a* is moved downwardly relative to the membrane circuit board 22, the keycap 201 is switched from the undepressed state to the depressed state. As the keycap 201 is moved downwardly, the first stabilizer bar 204, the second stabilizer bar 205, the first auxiliary bar 206 and the second auxiliary bar 207 are correspondingly swung. As shown in FIGS. 16A and 16B, the two third hook parts 2062 of the first auxiliary bar 206 are moved within the second sliding groove H2 of the first pedestal 2023 and the fifth sliding groove H5 of the second pedestal 2033 along the directions toward the first pivotal region P1 and the second pivotal region P2 (e.g., along the direction indicated by the arrow A2'). In addition, the two fourth hook parts 2072 of the second auxiliary bar 207 are moved within the fourth sliding groove H4 of the first pedestal 2023 and the seventh sliding groove H7 of the second pedestal 2033 along the directions toward the first pivotal region P1 and the second pivotal region P2 (e.g., along the direction indicated by the arrow A2'). As shown in FIGS. 16C and 16D, the two first hook parts 2042 of the first stabilizer bar 204 are moved within the first sliding groove H1 of the first pedestal 2023 and the sixth sliding groove H6 of the second pedestal 2033 along the directions toward the first pivotal region P1 and the second pivotal region P2 (e.g., along the direction indicated by the arrow A2'). In addition, the two second hook parts 2052 of the second stabilizer bar 205 are moved within the third sliding groove H3 of the first pedestal 2023 and the eighth sliding groove H8 of the second pedestal 2033 along the directions toward the first pivotal region P1 and the second pivotal region P2 (e.g., along the direction indicated by the arrow A2').

Figure 17:
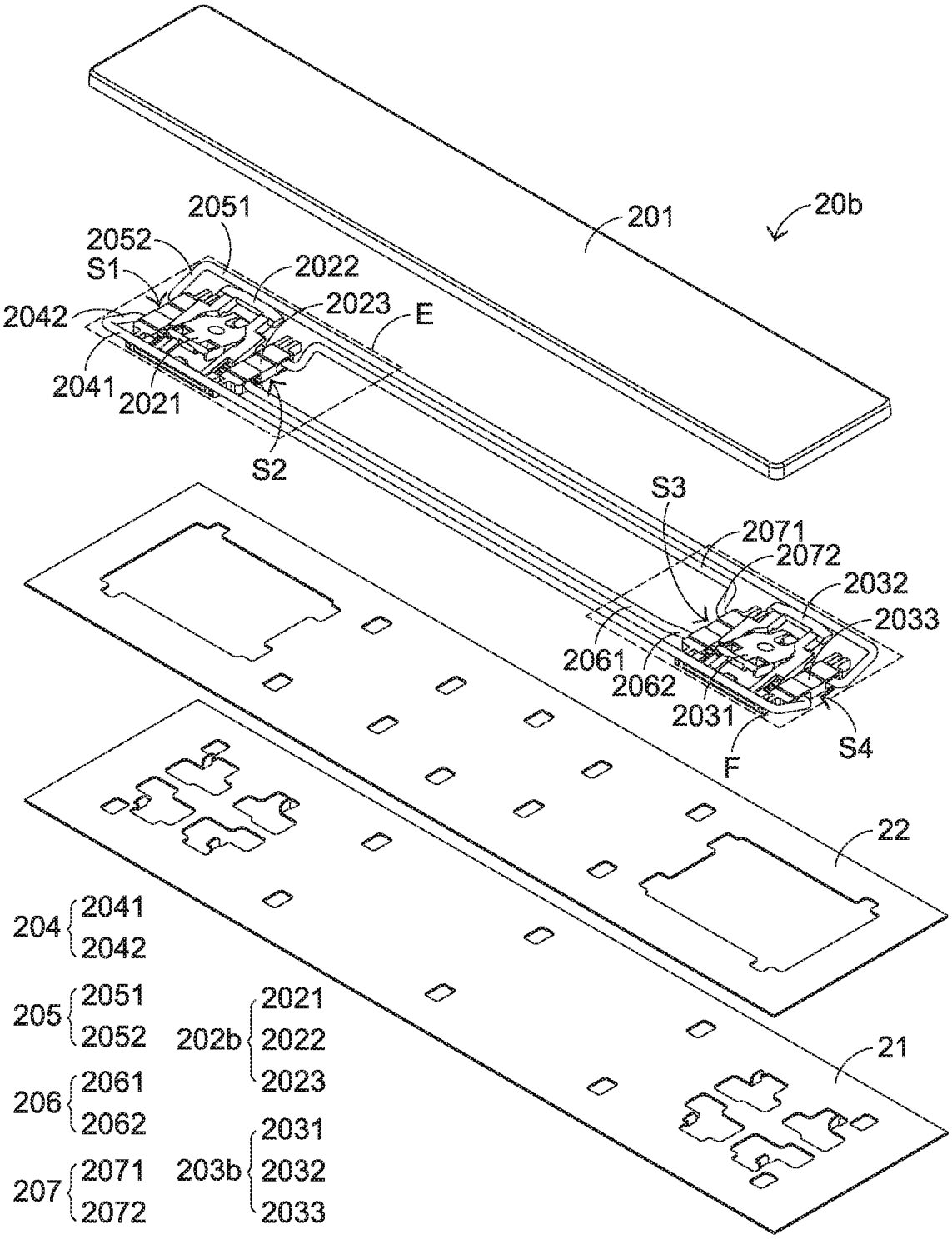
FIG. 17 is a schematic exploded view illustrating a key structure of a keyboard device according to a third embodiment of the present invention.
Figure 18:
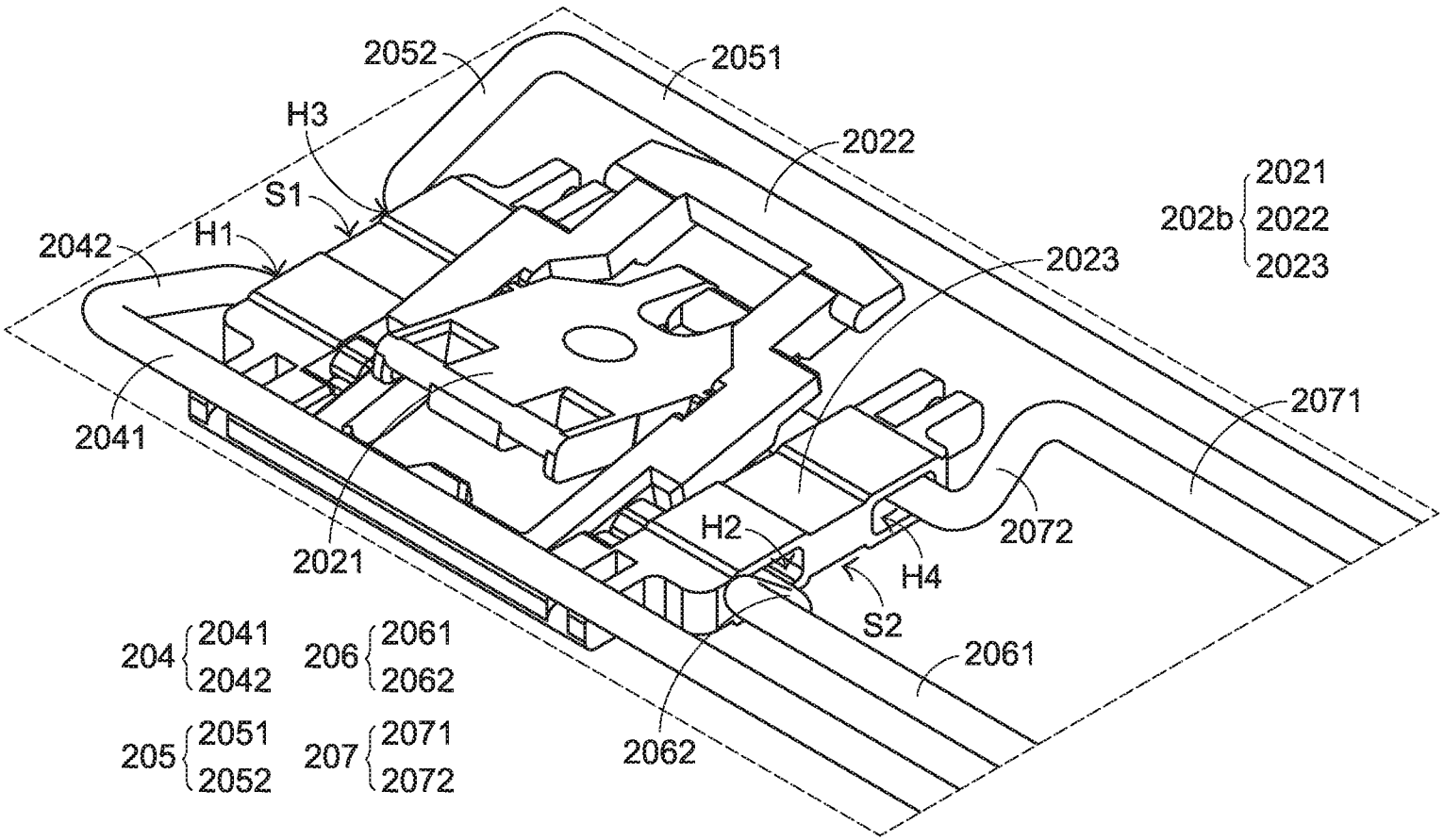
FIG. 18 is a schematic enlarged view illustrating the region E as shown in FIG. 17.
Figure 19:
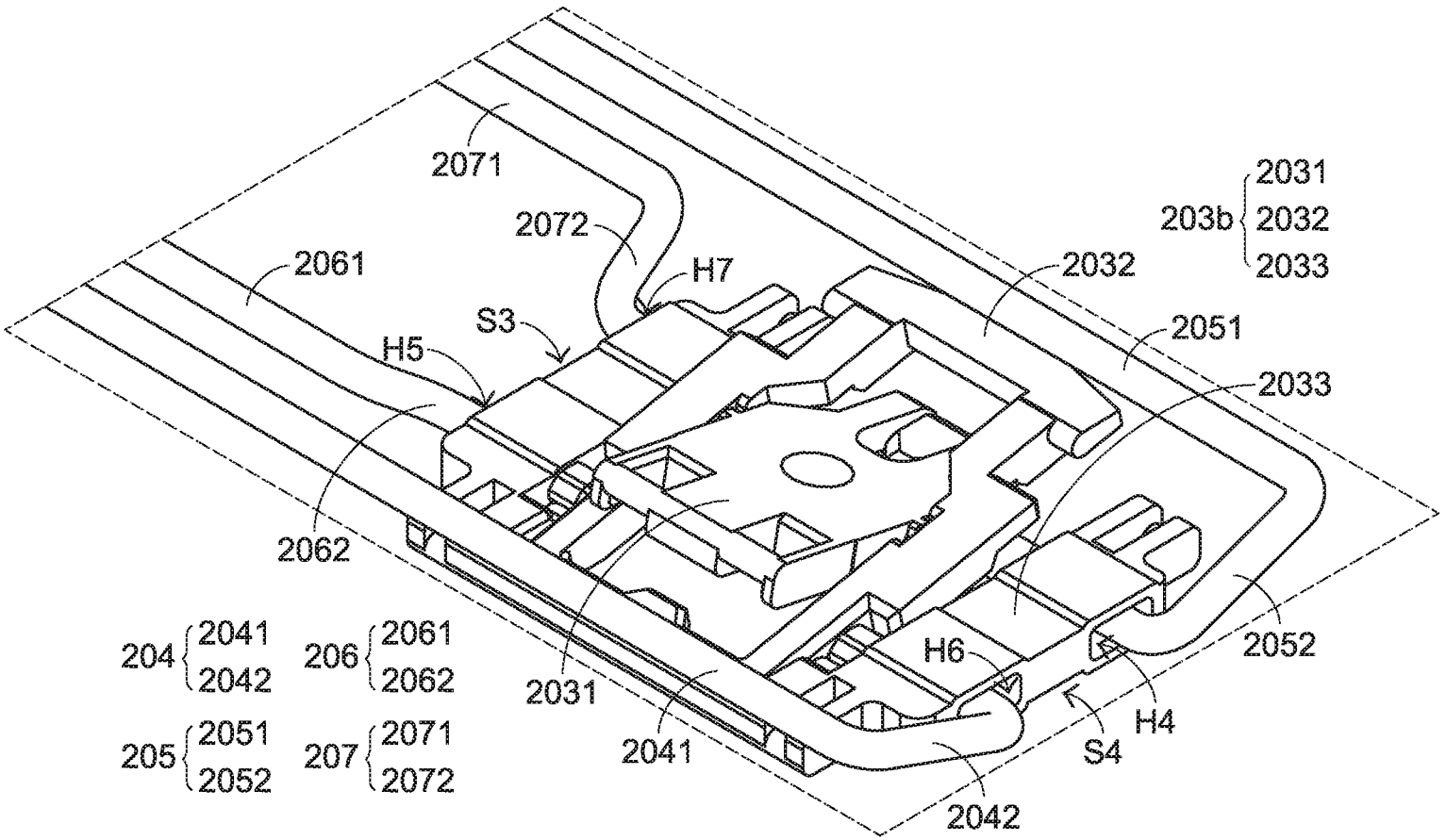
FIG. 19 is a schematic enlarged view illustrating the region F as shown in FIG. 17.

Please refer to FIGS. 17, 18 and 19. FIG. 17 is a schematic exploded view illustrating a key structure of a keyboard device according to a third embodiment of the present invention. FIG. 18 is a schematic enlarged view illustrating the region E as shown in FIG. 17. FIG. 19 is a schematic enlarged view illustrating the region F as shown in FIG. 17.

In comparison with the key structure 20*b* as shown in FIGS. 12, 13 and 14, the first connecting element 202 and the second connecting element 203 of the key structure 20*a* of this embodiment are scissors-type connecting elements.

In this embodiment, the first sliding groove H1, the second sliding groove H2, the third sliding groove H3 and the fourth sliding groove H4 are formed in the first pedestal 2023 of the first connecting element 202*b*, and the fifth sliding groove H5, the sixth sliding groove H6, the seventh sliding groove H7 and the eighth sliding groove H8 are formed in the second pedestal 2033 of the second connecting element 203*b*. The first sliding groove H1 and the third sliding groove H3 of the first pedestal 2023 are located at the first lateral side S1 of the first connecting element 202*b*. The second sliding groove H2 and the fourth sliding groove H4 of the first pedestal 2023 are located at the second lateral side S2 of the first connecting element 202*b*. The fifth sliding groove H5 and the seventh sliding groove H7 of the second pedestal 2033 are located at the third lateral side S3 of the second connecting element 203*b*. The sixth sliding groove H6 and the eighth sliding groove H8 of the second pedestal 2033 are located at the fourth lateral side S4 of the second connecting element 203*b*.

The two first hook parts 2042 of the first stabilizer bar 204 are pivotally coupled to the first sliding groove H1 of the first pedestal 2023 and the sixth sliding groove H6 of the second pedestal 2033, respectively. The two second hook parts 2052 of the second stabilizer bar 205 are pivotally coupled to the third sliding groove H3 of the first pedestal 2023 and the eighth sliding groove H8 of the second pedestal 2033. The two third hook parts 2062 of the first auxiliary bar 206 are pivotally coupled to the second sliding groove H2 of the first pedestal 2023 and the fifth sliding groove H5 of the second pedestal 2033. The two fourth hook parts 2072 of the second auxiliary bar 207 are pivotally coupled to the fourth sliding groove H4 of the first pedestal 2023 and the seventh sliding groove H7 of the second pedestal 2033.

While the keycap 201 of the key structure 20*a* is moved upwardly relative to the membrane circuit board 22, the keycap 201 is switched from a depressed state to an undepressed state. As the keycap 201 is moved upwardly, the first stabilizer bar 204, the second stabilizer bar 205, the first auxiliary bar 2012 and the second auxiliary bar 207 are correspondingly swung. The actions are similar to those as described in FIGS. 15A to 15D. While the keycap 201 of the key structure 20*a* is moved downwardly relative to the membrane circuit board 22, the keycap 201 is switched from the undepressed state to the depressed state. As the keycap 201 is moved downwardly, the first stabilizer bar 204, the second stabilizer bar 205, the first auxiliary bar 206 and the second auxiliary bar 207 are correspondingly swung. The actions are similar to those as described in FIGS. 16A to 16D.

In the above embodiments as shown in FIGS. 5 to 19, the key structure for the keyboard device is a Space key, a Shift key or any other similar multiple key with the larger area and length. Alternatively, the key structure of the present invention may be applied to an ordinary key of imputing an English letter or a symbol, a numeric key for inputting a number or a function key for providing a quick access function. That is, the applications of the key structure of the present invention are not restricted.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising: a membrane circuit board; a base plate located under the membrane circuit board; and a key structure comprising: a keycap located over the membrane circuit board, wherein the keycap is movable upwardly or downwardly relative to the membrane circuit board; a first connecting element connected between the keycap and the base plate, wherein the first connecting element has a first lateral side and a second lateral side, which are opposed to each other; a second connecting element connected between the keycap and the base plate, wherein the second connecting element has a third lateral side and a fourth lateral side, which are opposed to each other, wherein the third lateral side faces the second lateral side; at least one stabilizer bar pivotally coupled to the keycap, the first lateral side of the first connecting element and the fourth lateral side of the second connecting element; and at least one auxiliary bar pivotally coupled to the keycap, the second lateral side of the first connecting element and the third lateral side of the second connecting element, wherein while the keycap is moved upwardly or downwardly relative to the membrane circuit board, the at least one stabilizer bar and the at least one auxiliary bar are correspondingly swung; wherein the first connecting element and the second connecting element are butterfly-type connecting elements or scissors-type connecting elements.

2. The keyboard device according to claim 1, wherein the first connecting element comprises a first frame, a second frame and a first pedestal, and the second connecting element comprises a third frame, a fourth frame and a second pedestal, wherein the first frame and the second frame are connected between the keycap and the first pedestal, the first pedestal is connected with the base plate, and the first frame and the second frame are pivotally coupled to a first pivotal region, wherein the third frame and the fourth frame are connected between the keycap and the second pedestal, the second pedestal is connected with the base plate, and the third frame and the fourth frame are pivotally coupled to a second pivotal region, wherein while the keycap is moved upwardly or downwardly relative to the membrane circuit board, the first frame and the second frame are correspondingly swung relative to the first pivotal region as a fulcrum and the third frame and the fourth frame are correspondingly swung relative to the second pivotal region as a fulcrum.

3. The keyboard device according to claim 2, wherein the first frame comprises a first sliding groove and a second sliding groove, which are opposed to each other, wherein the second frame comprises a third sliding groove and a fourth sliding groove, which are opposed to each other, wherein the third frame comprises a fifth sliding groove and a sixth sliding groove, which are opposed to each other, wherein the fourth frame comprises a seventh sliding groove and an eighth sliding groove, which are opposed to each other, wherein the first sliding groove and the third sliding groove are located at the first lateral side of the first connecting element, the second sliding groove and the fourth sliding groove are located at the second lateral side of the first connecting element, the fifth sliding groove and the seventh sliding groove are located at the third lateral side of the second connecting element, and the sixth sliding groove and the eighth sliding groove are located at the fourth lateral side of the second connecting element, wherein the at least one stabilizer bar is pivotally coupled to the first sliding groove and the sixth sliding groove or pivotally coupled to the third sliding groove and the eighth sliding groove, and the at least one auxiliary bar is pivotally coupled to the second sliding groove and the fifth sliding groove or pivotally coupled to the fourth sliding groove and the seventh sliding groove.

4. The keyboard device according to claim 3, wherein the at least stabilizer bar comprises plural stabilizer bars including a first stabilizer bar and a second stabilizer bar, and the at least one auxiliary bar comprises plural auxiliary bars including a first auxiliary bar and a second auxiliary bar, wherein the first stabilizer bar is pivotally coupled to the first sliding groove and the sixth sliding groove, the second stabilizer bar is pivotally coupled to the third sliding groove and the eighth sliding groove, the first auxiliary bar is pivotally coupled to the second sliding groove and the fifth sliding groove, and the second auxiliary bar is pivotally coupled to the fourth sliding groove and the seventh sliding groove.

5. The keyboard device according to claim 4, wherein the first stabilizer bar comprises a first transverse bar part and two first hook parts, the second stabilizer bar comprises a second transverse bar part and two second hook parts, the first auxiliary bar comprises a third transverse bar part and two third hook parts, and the second auxiliary bar comprises a fourth transverse bar part and two fourth hook parts, wherein the two first hook parts are respectively located at two ends of the first transverse bar part, the two second hook parts are respectively located at two ends of the second transverse bar part, the two third hook parts are respectively located at two ends of the third transverse bar part, and the two fourth hook parts are respectively located at two ends of the fourth transverse bar part, wherein the two first hook parts of the first stabilizer bar are pivotally coupled to the first sliding groove and the sixth sliding groove, the two second hook parts of the second stabilizer bar are pivotally coupled to the third sliding groove and the eighth sliding groove, the two third hook parts of the first auxiliary bar are pivotally coupled to the second sliding groove and the fifth sliding groove, and the two fourth hook parts of the second auxiliary bar are pivotally coupled to the fourth sliding groove and the seventh sliding groove.

6. The keyboard device according to claim 5, wherein while the keycap is moved upwardly relative to the membrane circuit board, the first stabilizer bar, the second stabilizer bar, the first auxiliary bar and the second auxiliary bar are correspondingly swung, wherein as the keycap is moved upwardly, the two first hook parts are moved within the first sliding groove and the sixth sliding groove along directions away from the first pivotal region and the second pivotal region, the two second hook parts are moved within the third sliding groove and the eighth sliding groove along the directions toward the first pivotal region and the second pivotal region, the two third hook parts are moved within the second sliding groove and the fifth sliding groove along the directions away from the first pivotal region and the second pivotal region, and the two fourth hook parts are moved within the fourth sliding groove and the seventh sliding groove along the directions away from the first pivotal region and the second pivotal region.

7. The keyboard device according to claim 5, wherein while the keycap is moved downwardly relative to the membrane circuit board, the first stabilizer bar, the second stabilizer bar, the first auxiliary bar and the second auxiliary bar are correspondingly swung, wherein as the keycap is moved downwardly, the two first hook parts are moved within the first sliding groove and the sixth sliding groove along directions toward the first pivotal region and the second pivotal region, the two second hook parts are moved within the third sliding groove and the eighth sliding groove along the directions toward the first pivotal region and the second pivotal region, the two third hook parts are moved within the second sliding groove and the fifth sliding groove along the directions toward the first pivotal region and the second pivotal region, and the two fourth hook parts are moved within the fourth sliding groove and the seventh sliding groove along the directions toward the first pivotal region and the second pivotal region.

8. The keyboard device according to claim 2, wherein the first pedestal comprises a first sliding groove, a second sliding groove, a third sliding groove and a fourth sliding groove, and the second pedestal comprises a fifth sliding groove, a sixth sliding groove, a seventh sliding groove and an eighth sliding groove, wherein the first sliding groove and the third sliding groove are located at the first lateral side of the first connecting element, the second sliding groove and the fourth sliding groove are located at the second lateral side of the first connecting element, the fifth sliding groove and the seventh sliding groove are located at the third lateral side of the second connecting element, and the sixth sliding groove and the eighth sliding groove are located at the fourth lateral side of the second connecting element, wherein the at least one stabilizer bar is pivotally coupled to the first sliding groove and the sixth sliding groove or pivotally coupled to the third sliding groove and the eighth sliding groove, and the at least one auxiliary bar is pivotally coupled to the second sliding groove and the fifth sliding groove or pivotally coupled to the fourth sliding groove and the seventh sliding groove.

9. The keyboard device according to claim 8, wherein the at least stabilizer bar comprises plural stabilizer bars including a first stabilizer bar and a second stabilizer bar, and the at least one auxiliary bar comprises plural auxiliary bars including a first auxiliary bar and a second auxiliary bar, wherein the first stabilizer bar is pivotally coupled to the first sliding groove and the sixth sliding groove, the second stabilizer bar is pivotally coupled to the third sliding groove and the eighth sliding groove, the first auxiliary bar is pivotally coupled to the second sliding groove and the fifth sliding groove, and the second auxiliary bar is pivotally coupled to the fourth sliding groove and the seventh sliding groove.

* * * * *